US006042343A

United States Patent [19]

Semba et al.

[11] Patent Number: 6,042,343

[45] Date of Patent: Mar. 28, 2000

[54] VARIABLE DISPLACEMENT PUMP

[75] Inventors: Fusao Semba; Takashi Shimo, both of Higashimatsuyama, Japan

[73] Assignee: Jodosha Kiki Co., Ltd., Tokyo, Japan

[21] Appl. No.: 09/145,264

[22] Filed: Sep. 2, 1998

[30] Foreign Application Priority Data

Sep. 19, 1997 [JP] Japan ..... 9-254852

[51] Int. Cl.[7] ..... F04C 15/04; F04C 2/344

[52] U.S. Cl. ..... 417/220; 417/559; 418/30

[58] Field of Search ..... 417/220, 559; 418/30

[56] References Cited

U.S. PATENT DOCUMENTS

| | | | |
|---|---|---|---|
| 5,518,380 | 5/1996 | Fujii et al. | 418/26 |
| 5,562,432 | 10/1996 | Semba et al. | 418/26 |
| 5,895,209 | 4/1999 | Miyazawa | 418/26 |

FOREIGN PATENT DOCUMENTS

| | | | |
|---|---|---|---|
| 53-130505 | 11/1978 | Japan | F04C 1/16 |
| 56-143383 | 11/1981 | Japan | F04C 2/344 |
| 58-93978 | 6/1983 | Japan | F04C 2/344 |
| 63-14078 | 4/1988 | Japan | F04C 15/04 |
| 5-278622 | 10/1993 | Japan | B62D 6/00 |
| 7-243385 | 9/1995 | Japan | F04C 2/344 |

*Primary Examiner*—Erick R. Solis
*Assistant Examiner*—Arnold Castro
*Attorney, Agent, or Firm*—Sughrue, Mion, Zinn Macpeak & Seas, PLLC

[57] ABSTRACT

A cam case 23 is provided which swingably supports a cam ring 34 for forming a pump chamber 36 from a rotor in a state in which the rotor 33 having a vane 33*a* is moved to an eccentric position such that a swingable pin 35 axially disposed is used as a fulcrum. A pump body is formed adjacent to the two axial ends of the cam case. Moreover, a front body 21 and a rear body 22 for rotatively supporting a rotational shaft 40 of the rotor are disposed. As one of locating means for locating the two bodies and the cam case when an assembling process is performed, the swingable pin is employed. As another locating means, at least one of joining means for integrally connecting the two bodies and the cam case is a reamer bolt 45A.

7 Claims, 15 Drawing Sheets

VARIABLE DISPLACEMENT PUMP

BACKGROUND OF THE INVENTION

1. Field of the Invention

The present invention relates to a variable-displacement vane pump for use in an apparatus using pressurized fluid, such as a power steering unit for reducing force required to steer a steering wheel of an automobile.

2. Description of the Related Art

As a pump for a power steering unit, a positive-displacement vane pump has usually been employed which is directly operated by an engine of an automobile. The discharge flow rate of the foregoing positive displacement pump is changed to correspond to the number of revolutions of the engine. Therefore, the positive displacement pump has a characteristic which is mutually contradictory to auxiliary steering force which must be provided for the power steering unit. The auxiliary steering force must be enlarged when the automobile is stopped or the automobile runs at low speed and reduced when the automobile runs at high speed. Therefore, the positive displacement pump must have a large capacity which enables a discharge flow rate to be maintained with which required auxiliary steering force can be obtained even if the automobile runs at low speed with a small number of revolutions of the engine. Moreover, a flow control valve must be provided which controls the discharge flow rate to be not larger than a predetermined quantity when the automobile runs at high speed with a large number of revolutions of the engine. Therefore, the positive displacement pump involves increase in the required elements, a complicated overall structure and a complicated structure of passages. Thus, the overall size and cost cannot be reduced.

To solve the problems experienced with the above-mentioned positive displacement pump, variable-displacement vane pumps each of which is capable of reducing a discharge flow rate per revolution (cam cc/rev) in proportion to an increase in the number of revolutions have been disclosed. For example, variable-displacement vane pumps of the foregoing type have been disclosed in Japanese Patent Laid-Open No. 53-130505, Japanese Patent Laid-Open No. 56-143383, Japanese Patent Laid-Open No. 58-93978, Japanese Utility-Model Publication No.63-14078, Japanese Patent Laid-Open No.5-278622 and Japanese Patent Laid-Open No.7-243385. The foregoing variable displacement pumps do not need the flow control valve of the capacity type. Moreover, the variable displacement pump exhibits an excellent energy efficiency because waste of drive horsepower can be eliminated. Since return to a tank can be prevented, rise in the temperature of oil can be prevented. Moreover, problems of leakage in the pump and deterioration in the capacity efficiency can be prevented.

An example of the foregoing variable-displacement vane pump will simply be described with reference to FIG. 16 which shows the structure of the pump disclosed in Japanese Patent Laid-Open No. 7-243385. Referring to FIG. 16, reference numeral 1 represents a pump body, 1*a* represents an adapter ring and 2 represents a cam ring provided in an elliptic space 1*b* formed in the adapter ring 1*a* of the body 1, the cam ring 2 being swingably supported through a support shaft portion 2*a* which serves as a fulcrum for a swinging operation. The cam ring 2 is urged by an urging means (compression coil spring) for urging the cam ring 2 in a direction indicated by a hollow arrow F show in FIG. 16.

Reference numeral 3 represents a rotor eccentrically accommodated at a position adjacent to an end in the cam ring 2 in such a manner that a pump chamber 4 is formed at another end. Since the rotor 3 is rotated by an external power source, the rotor 3 forwards/rearwards moves a vane 3*a* which is held such that the vane 3*a* is able to move in the radial direction. Reference numeral 3*b* represents a drive shaft for the rotor 3. The rotor 3 is rotated in a direction indicated by an arrow shown in FIG. 16.

Reference numerals 5 and 6 represent fluid-pressure chambers formed in a pair on the two outer sides of the cam ring 2, the fluid-pressure chambers 5 and 6 being arranged to serve as high and low pressure portions in the elliptic space 1*b* of the adapter ring 1*a* of the body 1. In the chambers 5 and 6, passages 5*a* and 6*a* for introducing fluid pressures across a variable metering orifice 12 provided for a pump discharge-side passage 11 for controlling the swinging operation of the cam ring 2 are opened through a spool-type control valve 10 to be described later. When the fluid pressures across the variable metering orifice 12 in the pump discharge-side passage 11 are introduced through the passages 5*a* and 6*a*, the cam ring 2 is swung to a required direction. Thus, the capacity in the pump chamber 4 is varied so that the discharge flow rate is controlled to correspond to a flow rate in the discharge portion of the pump. That is, the flow rate in the discharge portion is controlled in such a manner that the flow rate in the discharge portion is reduced in inverse proportion to enlargement of the number of revolutions of the pump.

Reference numeral 7 represents an opening (a suction port) in the suction portion of the pump, the opening 7 being opened to face a pump suction-side region 4A of the pump chamber 4. Reference numeral 8 represents an opening (a discharge port) in the pump discharge portion, the opening 8 being opened to face a pump discharge-side region 4B of the pump chamber 4. The openings 7 and 8 are provided for either of a pressure plate or a side plate (not shown), the plates being securing walls for holding a pump element incorporating the rotor 3 and the cam ring 2 from two side portions.

The cam ring 2 is urged by the compression coil spring from the fluid-pressure chamber 6, as indicated with symbol F shown in the drawing. The cam ring 2 is pressed in a direction in which the capacity in the pump chamber 4 is maximized. Reference numeral 2*b* shown in the drawing represents a sealing member provided on the outer surface of the cam ring 2 so as to define the fluid-pressure chambers 5 and 6 in association with a bearing portion 2*a*, the chambers 5 and 6 being defined on the right-hand and left-hand portions in the pump chamber 4.

Reference numerals 7*a* and 8*a* represent whisker-like notches formed continuously from ends of the opening 7 in the pump suction portion and the opening 8 in the pump discharge portion. When a pumping operation is performed by rotating the rotor 3 so that the leading end of each vane 3*a* is slid on the inner surface of the cam ring 2, the notches 7*a* and 8*a* gradually relieve the fluid pressure from the high pressure portion to the low pressure portion in a region from a space adjacent to the ends of the openings 7 and 8 and held between the vanes to a space between the vanes adjacent to the foregoing space. Thus, surge pressure and pulsation are prevented.

The spool-type control valve 10 is operated by dint of different pressures P1 and P2 across a variable metering orifice 12 disposed at an intermediate position of the pump discharge-side passage 11. When fluid pressure P3 corresponding to the flow rate in the discharge portion of the pump is introduced into the fluid-pressure chamber 5 at a position on the outside of the cam ring 2, a sufficiently high flow rate can be maintained in the initial stage of the operation of the pump. In particular, in a state where the different pressure across the variable orifice 12 is raised to be a level not lower than a predetermined level when a load is applied because of the operation of the apparatus using the fluid pressure, the control valve 10 introduces the fluid pressure P1 upstream of the variable orifice 12 into the high-pressure-side fluid-pressure chamber 5 on the outside of the cam ring 2, the fluid pressure P1 being introduced as control pressure. Thus, any swing of the cam ring 2 can be prevented.

The variable-displacement vane pump having the above-mentioned structure incorporates elements, for example, the body 1, each having a complicated structure. What is worse, a large number of elements must be provided. Thus, there arises a problem in that each element cannot easily be machined and assembled. Moreover, the size and weight of the pump cannot easilybe reduced. Thus, the foregoing pump is susceptible to improvement.

For example, the conventional variable-displacement vane pump has the structure that the body 1 is composed of the front body and the rear body which are combined with each other by a socket and spigot joint method so that the foregoing pump is assembled. Since the socket and spigot joint method requires significant machining accuracy, there arises a problem in that the machining operation cannot easily be completed and a complicated labor is required when the assembling operation is performed.

Since the adapter ring 1*a* for swingably supporting the cam ring 2 must be fit to the body 1 so as to be held by the body 1, the fitting portion must requires significant machining accuracy and the assembling operation cannot easily be completed.

It might therefore be feasible to employ a structure in which the adapter ring 1*a* is formed into a cam case which serves as an intermediate body. Moreover, the front and rear bodies are joined to the two sides of the cam case. Then, the elements are integrally assembled by dint of joining bolts. However, the above-mentioned structure must be provided with locating means in the circumferential direction between the bodies and the directions of the joining surfaces. Each of the locating means must be provided with locating pins which are inserted into two portions. If the locating pins are provided, the number of elements increases and there arises a problem in that the machining operation and the assembling operation cannot easily be performed.

The above-mentioned variable displacement pump has a hydraulic pressure passage in the body 1 composed of bent passages because of the relationship in terms of the positions of the suction port, the pump chamber 4, the discharge chamber, the spool-type control valve 10, the discharge port and the like. To form the bent passages, a plurality of passage openings formed from the outer surface of the pump body are combined. The foregoing structure must be provided with blind caps which are press fit into ends of the passage holes opened in the outer surface of the body. To prevent leakage of oil through the blind cap portions, appropriate sealing means must be provided.

The above-mentioned variable displacement pump has the structure that a valve hole into which the spool-type control valve 10 is received is formed in a portion of the body 1. Moreover, a valve spool and a valve spring are inserted into the valve hole. Moreover, plugs for closing the opened end of the valve hole are screwed in the opened ends so that the opening are sealed. However, the above-mentioned structure requires the screw-in plugs and processes for cutting threads in the opened end of the valve holes, processes for press-fitting the plugs and processes for sealing the opened ends. Therefore, a contrivance with which the machining and assembling processes can easily be performed despite a furthermore simple structure is required.

As described above, the above-mentioned variable displacement pump is required to have a completely modified overall structure, to enable the structures of the elements to be simplified, the number of the elements to be reduced, the machining and assembling processes to be performed easily, reliability of the operation of the pump to be improved and the size, weight and cost of the pump to be reduced.

SUMMARY OF THE INVENTION

In view of the foregoing, an object of the present invention is to provide a variable displacement pump arranged such that the overall structure including a pump body is modified, the structure of the pump body is completely modified and known elements are maximally employed as a locating means for locating a cam case with respect to the pump body so as to be capable of reducing the number of elements and enabling machining and assembling process to be performed easily and reducing the size, weight and cost of the pump.

Another object of the present invention is to provide a variable displacement pump which is capable of simplifying hydraulic pressure passages which are formed in a pump body, enabling the machining process to be performed easily, reducing the number of blind caps required to plug openings, enabling the machining and assembling process to be performed easily and improving reliability as the hydraulic pressure passages.

Another object of the present invention is to provide a variable displacement pump having an arrangement that the structure of a control valve which is received in a valve hole formed in a pump body is improved to easily perform machining and assembling processes for the overall body of the pump, enable the number of elements and the number of machining processes to be reduced, simplify processes for machining and assembling the valve portion, reduce the cost, size and weight of the pump.

To achieve the above-mentioned objects, according to one aspect of the present invention, there is provided a variable displacement pump comprising: a cam ring for forming a pump chamber from a rotor in a state in which the rotor having a vane is moved to an eccentric position; a cam case mounted on a portion around the cam ring to swingably support the cam ring such that a swingable pin axially disposed in a portion of an outer periphery of the cam ring in a circumferential direction of the cam ring serves as a fulcrum so that the capacity of the pump chamber is changed, the cam case urging the cam ring in a direction in which the capacity of the pump chamber is maximized; front and rear bodies axially disposed on the two sides of the cam case to form a pump body; a rotational shaft pivotally supported by the two bodies so as to rotate the rotor; and locating means for locating the two bodies and the cam case during an assembling process, wherein the swingable pin serves as one of the locating means.

According to another aspect of the present invention, there is provided a variable displacement pump comprising: joining means for integrally connecting the cam case and the two bodies to each other in a state in which the cam case is held between the two bodies, wherein at least one of the joining means is a reamer bolt which is screwed into a reamer hole, and the reamer bolt, together with the swingable pin, serves as the locating means for locating the two bodies and the cam case. As an alternative to this, a locating pin is provided to, together with the swingable pin, serve as the locating means for locating the two bodies and the cam case.

The locating pin of a type which penetrates the cam case to locate the two bodies or the locating pins may be provided between the front body and the cam case and between the cam case and the rear body.

According to another aspect of the present invention, there is provided a variable displacement pump comprising: a cam ring for forming a pump chamber from a rotor in a state in which the rotor having a vane is moved to an eccentric position; a cam case mounted on a portion around the cam ring to swingably support the cam ring such that a swingable pin axially disposed in a portion of an outer periphery of the cam ring in a circumferential direction of the cam ring serves as a fulcrum so that the capacity of the pump chamber is changed, the cam case urging the cam ring in a direction in which the capacity of the pump chamber is maximized; front and rear bodies axially disposed on the two sides of the cam case which serves as an intermediate body so that the front and rear bodies form a pump body; a rotational shaft pivotally supported by the two bodies so as to rotate the rotor; a high-pressure chamber which is formed in the front body and into which pressure discharged from the pump chamber is introduced; and a high-pressure portion formed in the cam case, wherein a hydraulic passage for the high-pressure portion is constituted by a diagonal hole formed from the high-pressure chamber in the front body to be opened in an end surface which is a surface for joining the cam case and a hole for establishing the connection between the end surface of the cam case and the high-pressure portion.

A variable displacement pump according to the present invention has a structure that a control valve for swinging the cam ring is provided for the cam case, and a hydraulic passage for the high-pressure portion is constituted by a diagonal hole formed from the high-pressure chamber in the front body to be opened in an end surface which is a surface for joining the cam case and a hole for establishing the connection between the end surface of the cam case and the control valve.

According to another aspect of the present invention, there is provided a variable displacement pump comprising: a cam ring for forming a pump chamber from a rotor in a state in which the rotor having a vane is moved to an eccentric position; a cam case mounted on a portion around the cam ring to swingably support the cam ring such that a swingable pin axially disposed in a portion of an outer periphery of the cam ring in a circumferential direction of the cam ring serves as a fulcrum so that the capacity of the pump chamber is changed, the cam case urging the cam ring in a direction in which the capacity of the pump chamber is maximized; front and rear bodies axially disposed on the two sides of the cam case which serves as an intermediate body so that the front and rear bodies form a pump body; a rotational shaft pivotally supported by the two bodies so as to rotate the rotor; and a spool-type control valve for swinging the cam ring, wherein a valve hole for forming the spool-type control valve provided for the cam case such that an end of the valve hole is opened in the cam case, and a hole is formed adjacent to an opened end of the valve hole in a direction perpendicular to the valve hole such that the hole penetrates the cam case, and a pin is inserted into the hole.

According to the present invention, the front body, the rear body and the cam case serving as the intermediate body for swingably holding the cam ring are combined with each other in a state in which required elements have been accommodated. The overall body is integrally assembled by the plural joining means. At this time, the swingable pin for causing the cam ring to swingably be supported by the cam case is used as one of means for locating the elements around the rotational shaft and the elements in the direction of the joining surface. As another locating means, at least one of the joining means is a reamer bolt or a locating pin disposed at a required position. Thus, the assembling process is performed after required locating has been performed.

The present invention has the structure that the cam case is provided with a high pressure portion, such as the control valve. The connection between the high pressure portion and the high pressure portion formed in the front body, such as the pressure chamber (the discharge chamber) in the discharge portion of the pump, is established by the diagonal hole formed from the high pressure portion and opened in the joining surface of the front body with which the front body is joined to the cam case and the connection hole formed in the cam case. Thus, the hydraulic passages in the high pressure portion can be formed in the above-mentioned state of assembling.

The present invention has the structure that the valve hole for the spool-type control valve is formed in such a manner that an end of the valve hole is opened in the cam case. The hole is formed adjacent to the opened end such that the hole is formed in a direction perpendicular to the valve hole and the hole penetrates the cam case. After the elements for forming the valve are accommodated in the valve hole, the pin, such as the spring pin, is inserted into the foregoing hole. Thus, the accommodated elements are anchored. Removal of the pin to either of the two sides is prevented by the front and rear bodies disposed on the two sides of the cam case.

The variable displacement pump is a vane-type oil pump for discharging hydraulic pressure for use as a hydraulic pressure source for a power steering unit of an automobile. The variable displacement pump is not limited to this.

The cam ring is swingably supported by a bearing portion comprising a swingable pin having a portion which serves as a fulcrum of a swinging operation in the space formed in the pump body. The cam ring is swung by the fluid pressures in the first and second fluid-pressure chambers formed on the two sides of a segment which passes through the bearing portion and the urging means provided for the fluid-pressure chamber in the low pressure portion.

The pump body is constituted by the two bodies and the cam case manufactured by precise casting processes, such as aluminum die-cast. The internal passages, the internal spaces and the hole portions, such as the valve hole, are formed by casting or boring. The present invention is not limited to the foregoing methods.

The shape of the shaft serving as the rotational shaft is formed into a straight shape as much as possible. The shaft serving as the rotational shaft is pivoted on each body at each position by using bushes, such as wrapping bearings each having a dual structure and made of aluminum and white metal. Thus, the shaft is supported by a dual support structure. The present invention is not limited to the foregoing structure.

BRIEF DESCRIPTION OF THE DRAWINGS

FIGS. 14A to 14C show another embodiment of the variable displacement pump according to present invention, in which FIG. 14A is a side view showing the rear body when viewed from the joining surface with the cam case, FIG. 14B is a side cross sectional view and FIG. 14C is a cross sectional view showing an essential portion of a portion for receiving a relief valve;

DETAILED DESCRIPTION OF THE PREFERRED EMBODIMENTS

Figure 1:
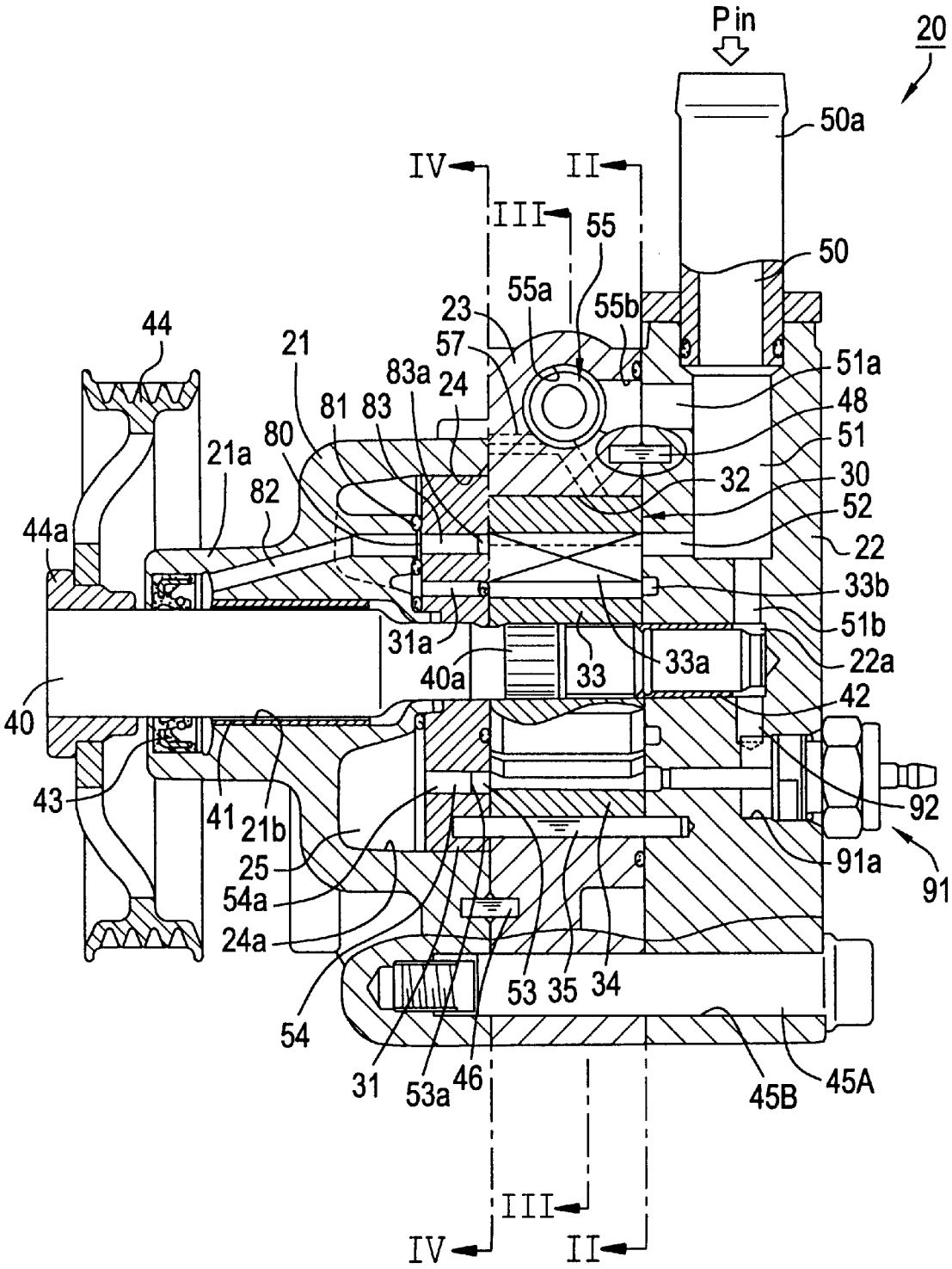
FIG. 1 is a vertical cross sectional view showing an essential portion of an embodiment of a variable displacement pump according to the present invention.

Now, a description will be given in more detail of preferred embodiments of the present invention with reference to the accompanying drawings.

FIGS. 1 to 12 show an embodiment of a variable displacement pump according to the present invention. Referring to the drawings, the variable displacement pump is a vane-type oil pump which serves as a source for generating hydraulic pressure for a power steering unit.

As shown in FIGS. 1, 4 to 9, a vane-type variable displacement pump 20 incorporates a front body 21, a rear body 22 and a cam case 23 serving as an intermediate body which form a pump body.

As shown in FIGS. 1, 4, 5A and 5B, the front body 21 has a small-diameter portion 21*a* projecting to either end. In the central portion of the front body 21, a shaft hole 21*b* through which a rotational shaft of a rotor 33 to be described later is inserted is formed.

As shown in FIGS. 1, 4, 5A and 5B, a circular space 24 for accommodating a pressure plate 31 which is one of pump elements 30 is formed in the joining surface of the front body 21 in the large-diameter portion with which the cam case 23 is joined. Moreover, an annular recess 24*a* is formed at the back of the circular space 24. The annular recess 24*a* is formed in such a manner that a discharge chamber 25 is formed between a pressure plate 31 to be described later and the annular recess 24*a*, the discharge chamber 25 being a chamber into which pressurized oil in the discharge portion of the pump is introduced.

As shown in FIGS. 1, 2, 3, 5A–5C, 6A–6B and 7A–7E, the cam case 23 has an accommodating space 32 for accommodating a pump cartridge which is the pump element 30. The accommodating space 32 has an ellipse-like shape extending to the right and left in FIGS. 2 and 3. The accommodating space 32 swingably supports a cam ring 34 mounted on a portion around a rotor 33 in a state in which the rotor 33 having a vane 33*a* is moved eccentrically to either side such that a swingable pin 35 disposed in a portion in the circumferential direction and placed in the axial direction is used as a fulcrum. Thus, the capacity of the pump chamber 36 can be varied.

The cam ring 34 forms a pump chamber 36 between an inner surface and an outer surface of the rotor 33. The cam ring 34 is urged in a direction in which the capacity of the pump chamber 36 is maximized by a compression coil spring 37 disposed on either side of the cam case 23 and serving as an urging means.

Figure 16:
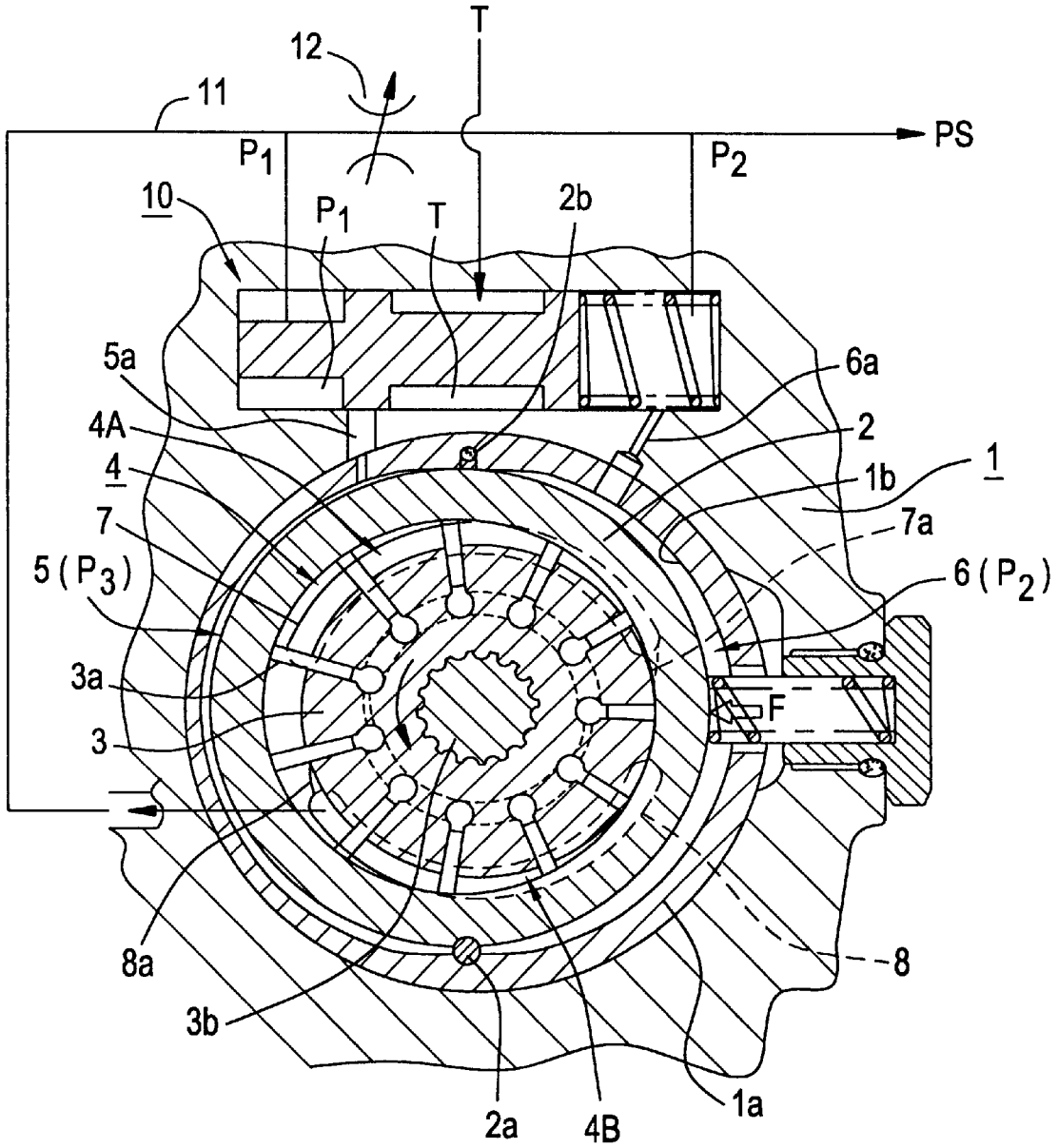
FIG. 16 is a diagram showing the structure of an essential portion of a conventional variable displacement pump.

The cam case 23 is a member corresponding to an adapter ring (1*a* shown in FIG. 16) for swingably holding the cam ring 34 in the pump body. The rear body 22 is joined in contact with the rear portion of the cam case 23. In corporation with a pressure plate 31 disposed in the circular space 24 adjacent to the front body 21, the cam case 23 forms the pump chamber 36 between the rotor 33 and the cam ring 34.

Reference numeral 40 represents a drive shaft serving as a rotor for rotating the rotor 33 of the pump elements 30 from an outer position. The drive shaft 40 penetrates the front body 21 and the rotor 33. The inner end of the drive shaft 40 is received by a shaft hole 22*a* formed in the rear body 22.

As shown in FIG. 1, the drive shaft 40 is arranged to be integrally rotated with the rotor 33 by dint of serration joint (or a key joint) The drive shaft 40 is rotatively supported at two points by bushes 41 and 42 provided for shaft holes 21*b* and 22*a* of the front body 21 and the rear body 22.

The bushes 41 and 42 are wrapping bearings made of, for example, aluminum and white metal and having a dual structure. The bushes 41 and 42 are disposed for a predetermined length in the axial direction so as to rotatively support the drive shaft 40 with required strength.

Referring to FIG. 1, reference numeral 43 represents an oil seal disposed at the opened end of the small-diameter portion 21*a* of the shaft hole 21*b* of the front body 21, the shaft hole 21*b* having the bush 41. Reference numeral 44 represents a pulley 44 provided for a pulley support ring 44*a* disposed at an outer end of the drive shaft 40 by press fitting or the like. When rotative force is transmitted from an outer power source, such as a electric motor, to the pulley 44, the drive shaft 40 can be rotated.

In this embodiment, the pump body for constituting the variable displacement pump 20 incorporates the front and rear bodies 21 and 22 and the cam case 23 manufactured by precise casting, such as aluminum die-cast. The shape of the drive shaft 40 serving as the rotational shaft is formed to have the straight shape as much as possible. Moreover, the drive shaft 40 is borne at each of the front and rear bodies 21 and 22 by the bushes 41 and 42. Therefore, the following advantages can be obtained.

That is, the conventional pump has a structure that the ball bearing for bearing the drive shaft 40 is provided for a position adjacent to the pulley 44. Moreover, a needle bearing and a bush are disposed in the body. Thus, the drive shaft 40 is borne at three points. On the other hand, this embodiment has the structure that the drive shaft 40 is supported at two points by the bushes 41 and 42. Moreover, the drive shaft 40 is formed into the straight shape as much as possible. Therefore, the outer diameter of the pump body can be reduced and the number of the elements can be reduced. Thus, the cost can be reduced.

In this embodiment, the length of the bush 41 in the front body 21 in the axial direction is elongated and the bush 41 is positioned adjacent to the pulley 44 in the small-diameter portion 21*a*. Therefore, resistance against a bending load can be raised despite the small diameter of the shaft. Moreover, the load capacity (a PV value) as the pump can be enlarged. Since the drive shaft 40 is borne by the bushes 41 and 42 at the positions adjacent to the rotor 33, a problem which arises because of an eccentric load occurring due to the hydraulic pressure can be prevented.

Since the drive shaft 40 is formed into the substantially straight shape as described above, the hole 31*a* in the pressure plate 31 for introducing high hydraulic pressure into a base portion (33*b* ) of the vane 33*a* can be formed into a straight shape in the axial direction in place of the conventional diagonal hole. Therefore, the passage for introducing hydraulic oil can be enlarged. Moreover, the straight hole can easily be formed in the pressure plate 31 by a machining process. When the straight hole is formed when the pressure plate 31 is molded, the cost can be reduced.

The front body 21, the rear body 22 and the cam case 23 holding the front and rear bodies 21 and 22 are stacked in a state in which the internal elements have been accommodated. Then, the stacked elements are joined by four joining bolts 45 which are joining means so that the elements are integrally assembled. An end surface of the rear body 22 which is in contact with an end of the cam case 23 has a function to serve as a side plate of the pump elements 30.

Figure 2:
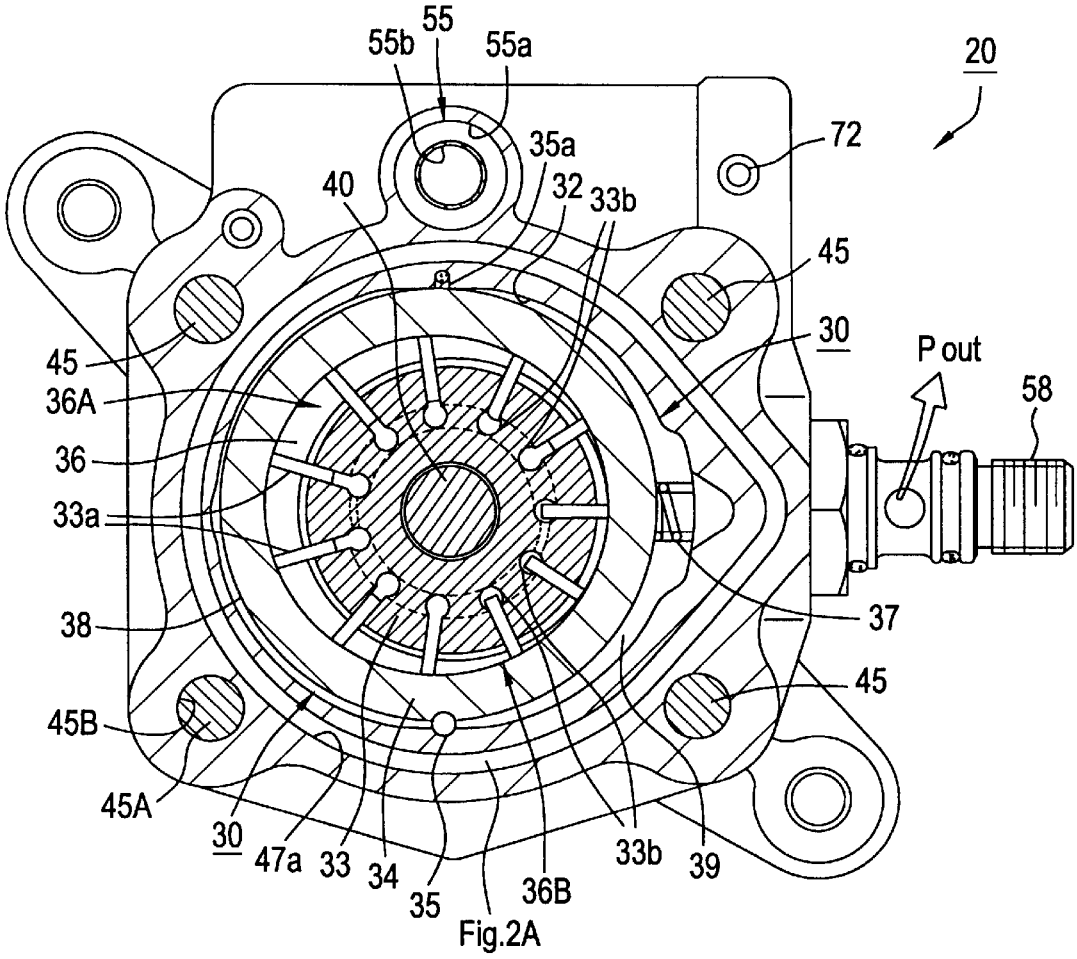
FIG. 2 is a horizontal cross sectional view taken along line II—II shown in FIG. 1 and showing a portion in the vicinity of a pump chamber of the variable displacement pump.
Figure 2A:
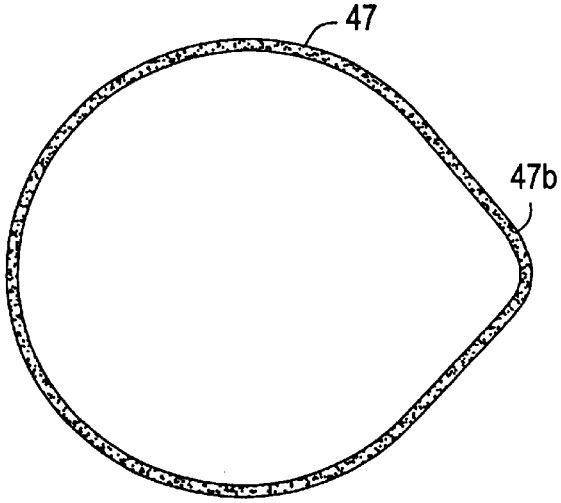

Referring to FIG. 2, reference numeral 47 represents an "O" ring mounted on a recess grove 47*a* formed in the side portion of the cam case 23 and arranged to seal the pump chamber 36 formed by the pump elements 30 and the first and second fluid-pressure chambers 38 and 39 for swinging the cam ring 34. The "O" ring 47 has an enlarged portion 47*b* for bypassing the relief valve 74.

In addition to the above-mentioned structure according to this embodiment, a swingable pin 35 for swingably supporting the cam ring 34 in the cam case 23 is provided as one of means for locating the three-piece structure composed of the front body 21, the rear body 22 and the cam case 23 serving as the intermediate body which is held between the front and rear bodies 21 and 22.

Since the above-mentioned structure incorporates the swingable pin 35 of the cam ring 34 which is a conventional element as the locating member, any redundant element is not required. Thus, the number of elements of the pump can be reduced and the cam case and the two bodies can reliably be located at the joining surfaces in the directions of the planes and the circumferential directions. That is, it might be considered to locate the above-mentioned members by using two means for only locating the positions, such as the locating pins. In this embodiment, the swingable pin 35 having another functions is employed as at least either of the locating means.

In this embodiment, another locating means is arranged such that a reamer bolt 45A arranged to be received in a reamer hole 45B is employed as at least one of the joining bolts 45 for joining the two bodies 21 and 22 to each other. Therefore, the number of elements can be reduced. Since the reamer bolt 45A is able to reliably bear an eccentric load generated by dint of the hydraulic pressure which acts on the two bodies 21 and 22 and the cam case 23, the reliability of the assembled pump 20 can be maintained.

In the above-mentioned embodiment, the reamer bolt 45A is employed as one of the joining bolts serving as the locating means together with the swingable pin 35. The present invention is not limited to the above-mentioned structure. For example, the structure shown in FIG. 1 may be structured such that locating pins 46 and 48 may be provided between the front body 21 and the cam case 23 and between the cam case 23 and the rear body 22. Even if the reamer bolt 45A is not provided, the two bodies 21 and 22 and the cam case 23 can easily be located and assembled. In this case, when holes formed when the two bodies 21 and 22 and the cam case 23 have been precisely cast are used as holes into which the locating pins 46 and 48 are inserted, the machining process can easily be performed. Since the joining bolts 45 is able to freely be tightened, the assembling process can easily be performed.

Although the structure shown in FIG. 1 incorporates the two locating pins 46 and 48, the present invention is not limited to this. One locating pin may be inserted into a required portion to as well as have the locating function. The essential portion lies in that the cam case 23 which is held between the front and rear bodies 21 and 22 paired with each other is located in the rotational direction and the direction of the plane in each joining surface by using the swingable pin 35 which swingably supports the cam ring 34.

Reference numeral 50 represents a suction port formed in a portion of the rear body 22. The port 50 has a suction-side pipe 50*a* which is a connector in the suction portion of the pump 20. Hydraulic oil for the suction portion is introduced from a tank. Hydraulic oil is allowed to pass through a suction-side passage 51 formed in the rear body 22, and then allowed to pass through a suction-side opening 52 opened in a suction-side region 36A of the pump chamber 36 formed in the cam ring 34 of the cam case 23 from the rotor 33. Then, hydraulic oil is sucked into the pump chamber 36. Then, hydraulic oil undergoes a pumping action because of the operation of the vane 33*a* so that hydraulic oil is discharged through a discharge-side opening 53 and the discharge-side passage 54 adjacent to the pressure plate 31 opened in a discharge-side region 36B. Then, hydraulic oil is, on the backside of the pressure plate 31, introduced into the discharge chamber 25 (a discharge-side pressure chamber) which is a high pressure chamber formed by the annular recess 24*a* of the front body 21.

Figure 14A:
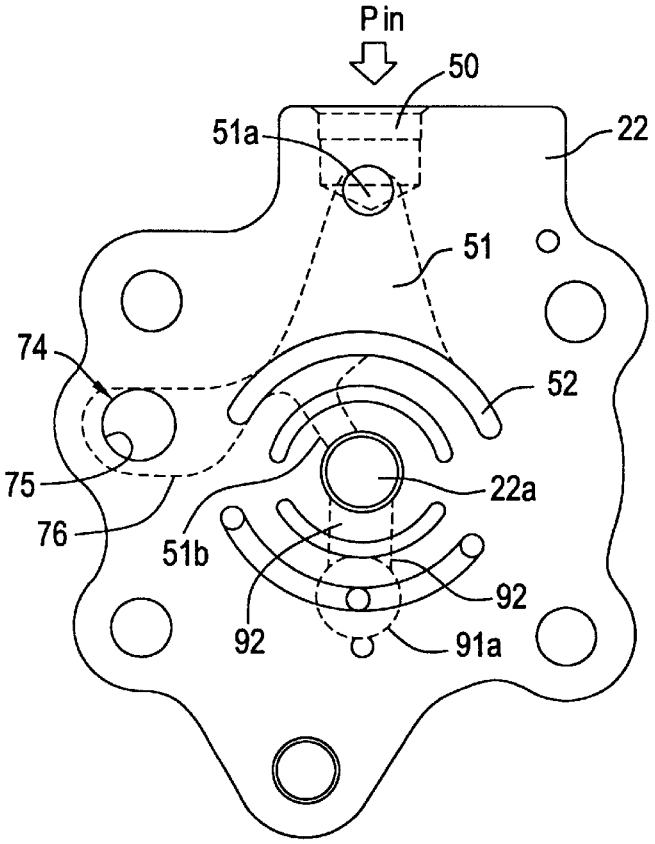
Figure 14B:
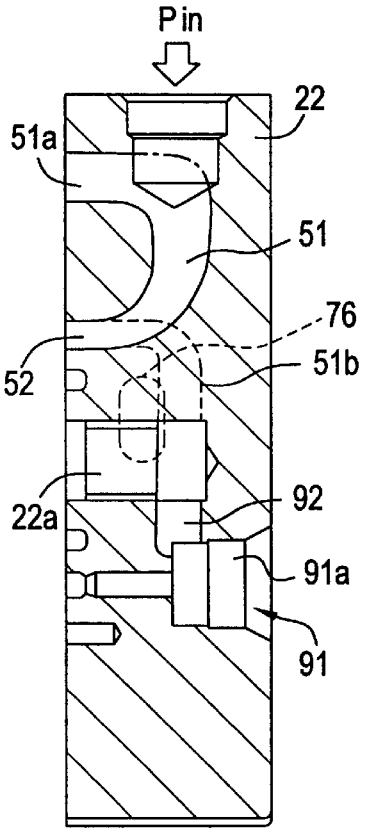
Figure 14C:
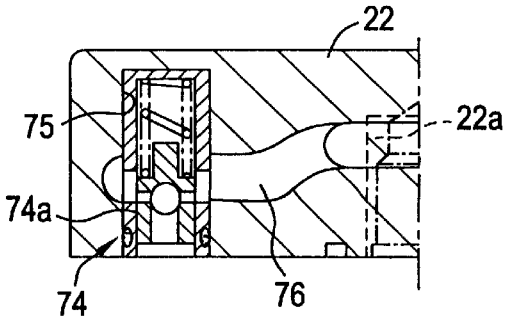

In the embodiment shown in FIGS. 1 and 8A–8C, the suction port 50 and the suction-side passage 51 in the rear body 22 are constituted by the passage holes formed by machining. The present invention is not limited to this. When holes formed by using cores when the rear body 22 is cast are employed, for example, as shown in FIGS. 14A and 14B, the machining process can easily be performed and the cost can be reduced. Since the basic structure is the same as that shown in FIG. 1, the foregoing method is omitted from description.

Figure 3:
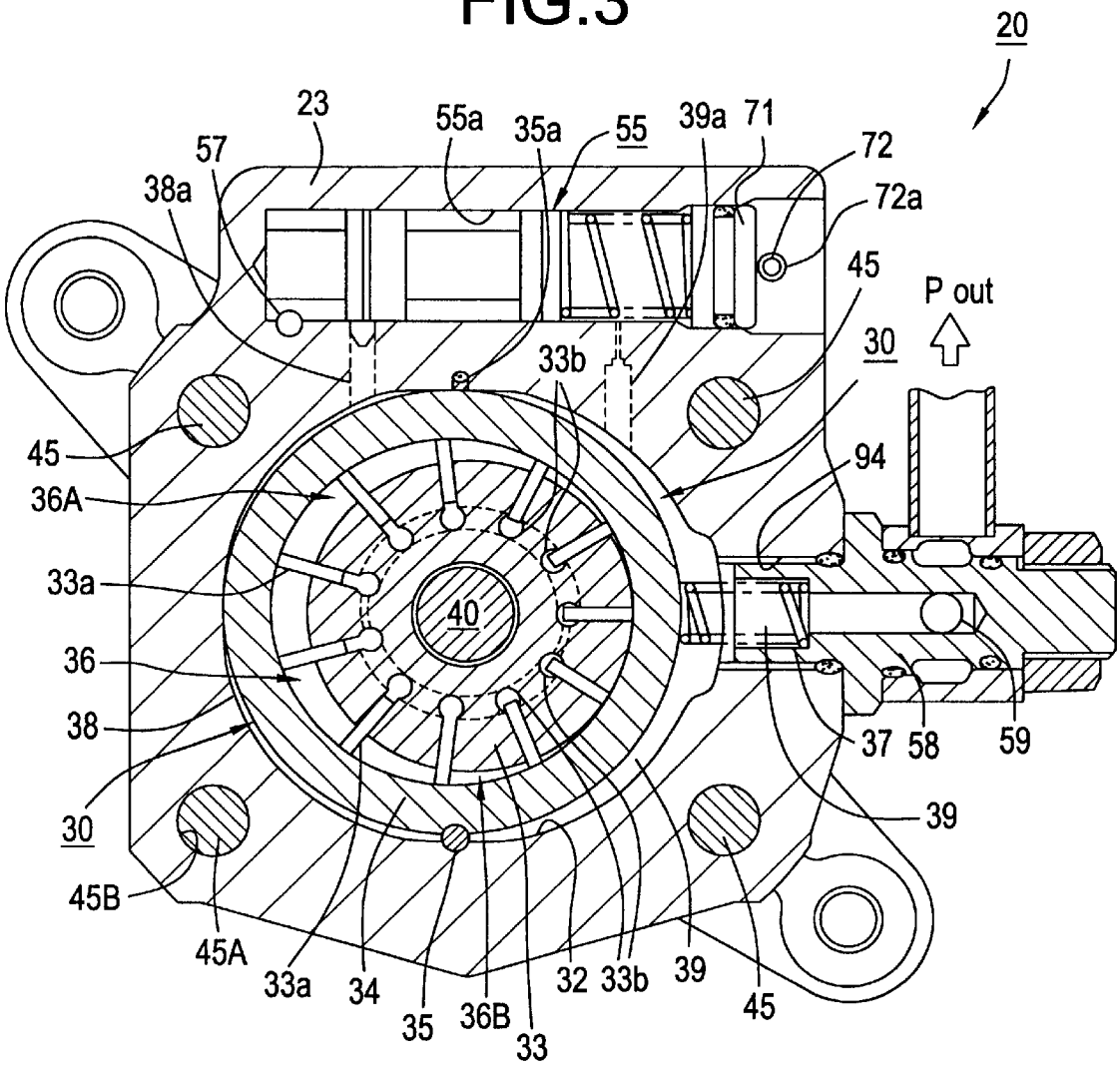
FIG. 3 is a horizontal cross sectional view taken along line III—III shown in FIG. 1 and showing the portion in the vicinity of a pump chamber of the variable displacement pump.
Figure 5B:
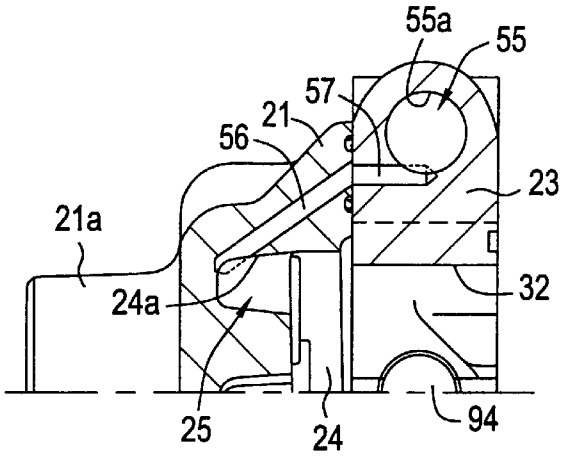
FIG. 5B is a cross sectional view taken along line V—V shown in FIG. 5A
Figure 12:
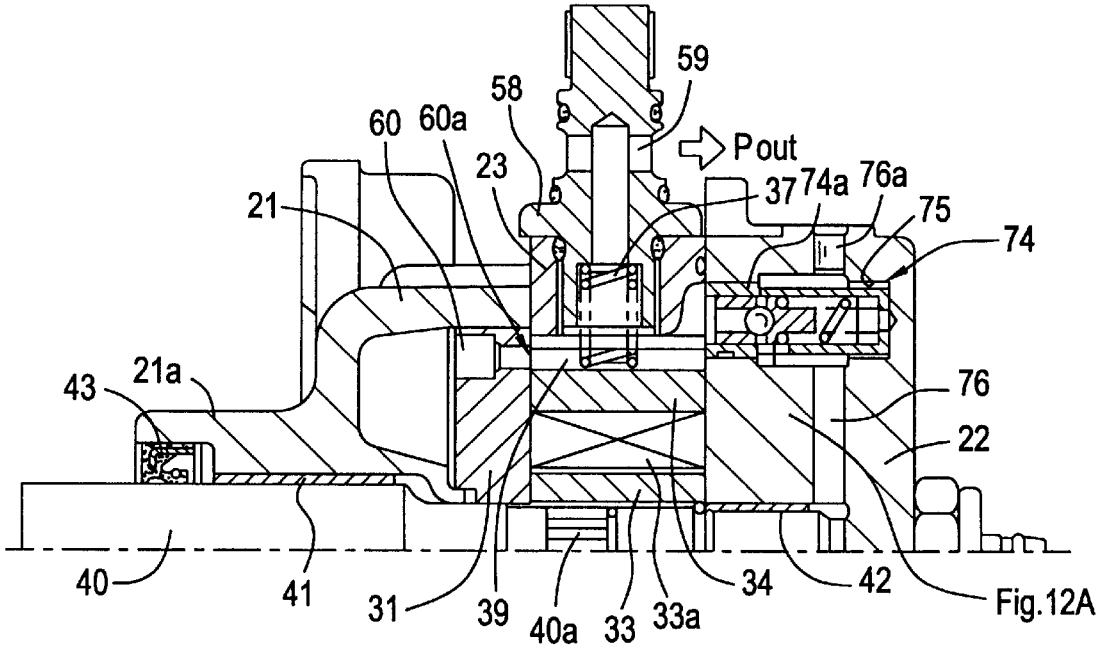
FIG. 12 is an enlarged cross sectional view taken along line XII—XII shown in FIG. 9.
Figure 12A:
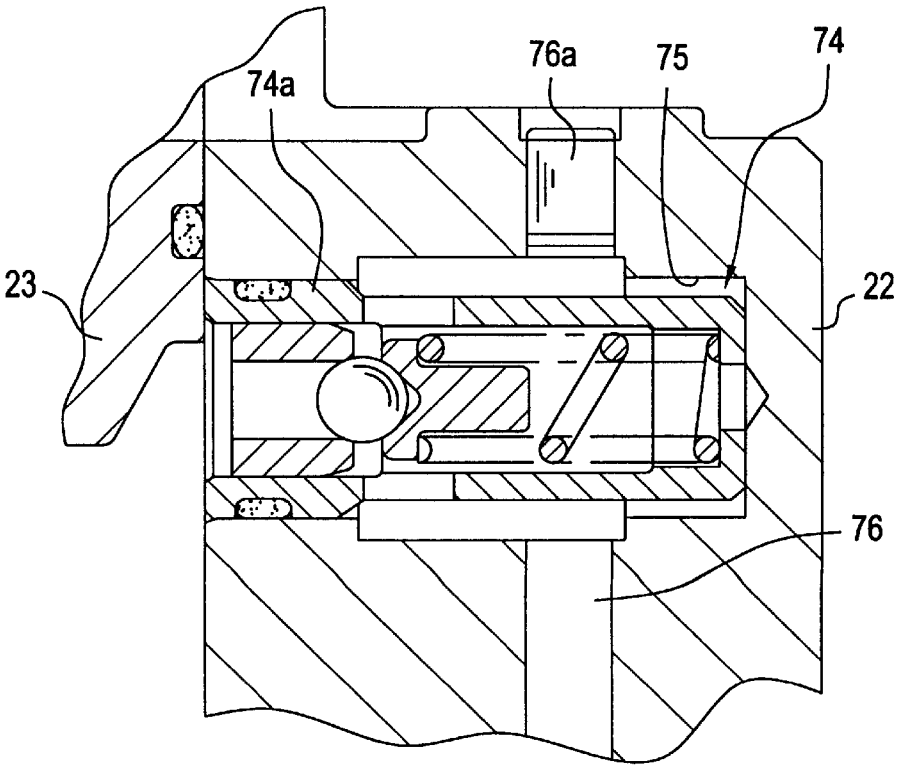
FIG. 12A shows an essential portion.

The discharge chamber 25 is, through hydraulic-pressure passages 56 and 57, connected to a high-pressure chamber of the control valve 55 formed in a portion of the cam case 23 shown in FIGS. 5B and FIG. 3 and serving as the high-pressure portion. On the other, as shown in FIG. 12, hydraulic oil is allowed to pass through a discharge-side passage 60 having a metering orifice 60*a*, and then introduced into the second fluid-pressure chamber 39 and an internal passage in a discharge-side connector 58 so as to be discharged through a discharge-side port 59.

In the discharge-side passage 60, there is formed the variable metering orifice 60*a* which is capable of changing the opened area by the fluid-pressure passage hole 60 opened in the second fluid-pressure chamber 39 and the side portion of the cam ring 34. The variable metering orifice 60*a* is formed when the small-diameter opened end of the discharge-side passage 60 is opened/closed in the side wall portion because the cam ring 34 is displaced. When the amount of opening/closing of the orifice 60*a* is arranged to be controlled in accordance with the level of the fluid pressure in the discharge portion, the displacement of the cam ring 34 can be controlled as desired. Thus, the flow rate characteristic can be varied.

In this embodiment, the first and second fluid pressure chambers 38 and 39 are formed between the outer surface of the cam ring 34 and the cam-ring accommodating space 32 in the cam case 23 so as to swing the cam ring 34. Hydraulic pressure which is supplied to the first and second fluid pressure chambers 38 and 39 is controlled by a control valve 55 which is disposed in a portion of the cam case 23. The control valve 55 controls the hydraulic pressure through passage holes 38*a* and 39*a* to correspond to the flow rate of the pressurized fluid from the pump chamber 36. As shown in FIGS. 5B and 7A–7E, a hydraulic-pressure passage in the high pressure portion is constituted by a diagonal hole 56 formed from the discharge chamber 25 in the front body 21 and opened in an end surface which is a joining surface for joining the cam case 23. Moreover, also a hole 57 for establishing the connection between the end surface of the cam case 23 and the valve hole 55*a* of the control valve 55 is an element for constituting the foregoing hydraulic-pressure passage.

Figure 5C:
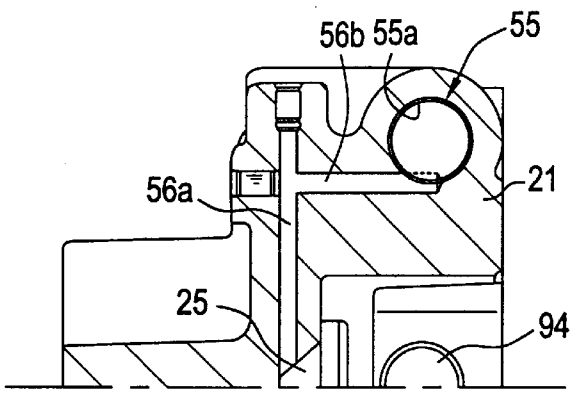
FIG. 5C is a diagram showing a conventional example corresponding to FIG. 5B.
Figure 5A:
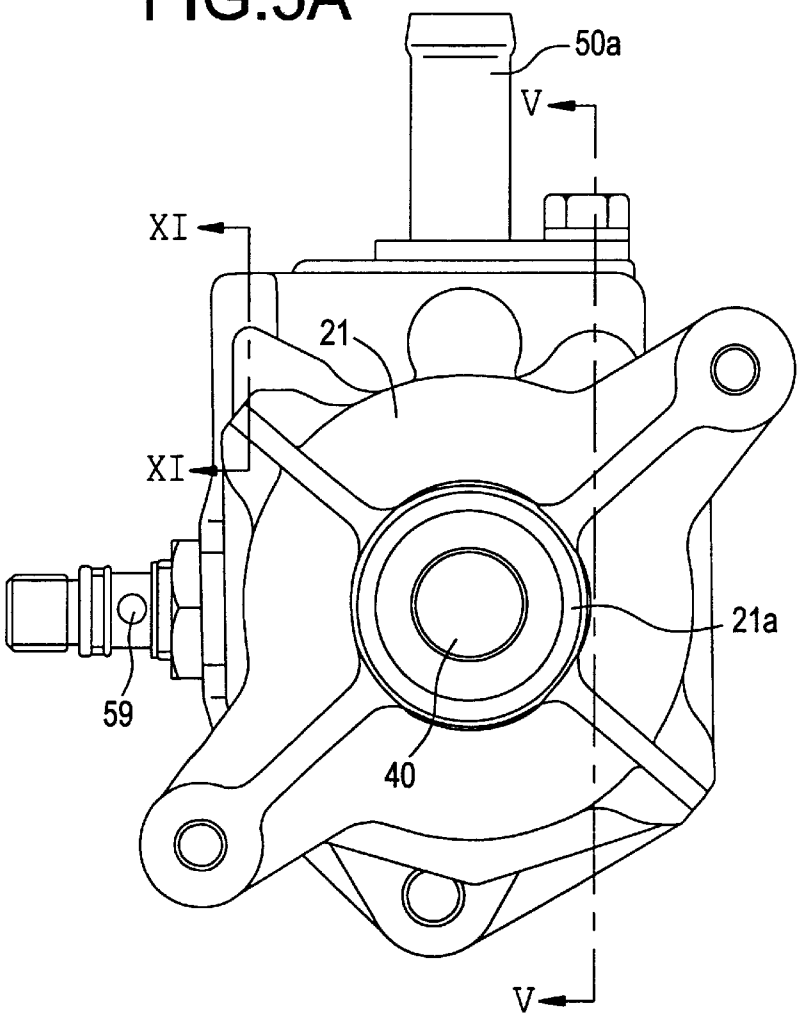
FIG. 5A is a side view showing the variable displacement pump shown in FIG. 1 when viewed from the front body.
Figure 6A:
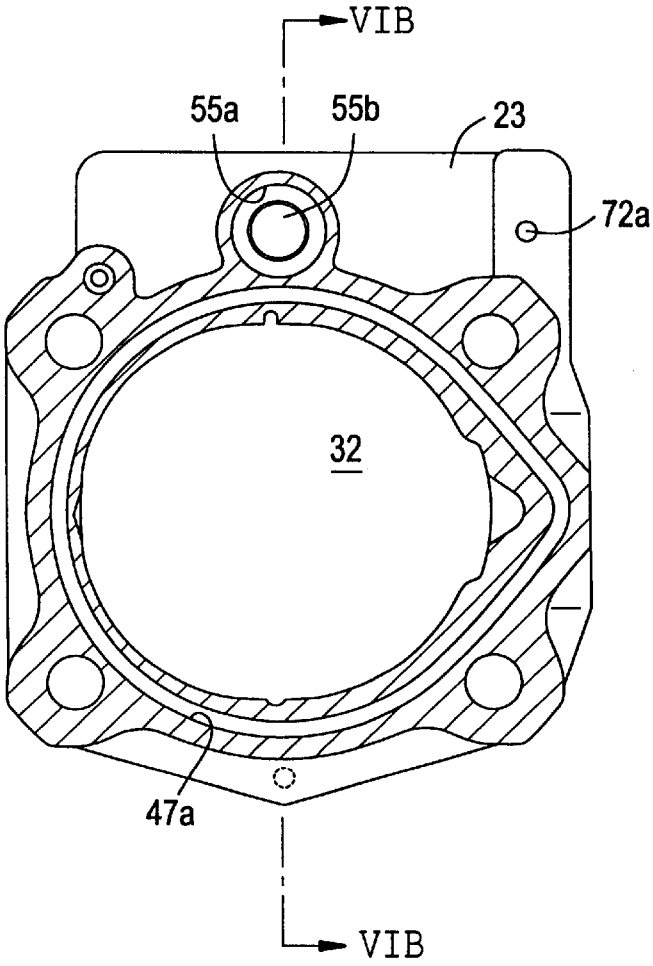
FIG. 6A is a front view of a cam case of the variable displacement pump shown in FIG. 1
Figure 6B:
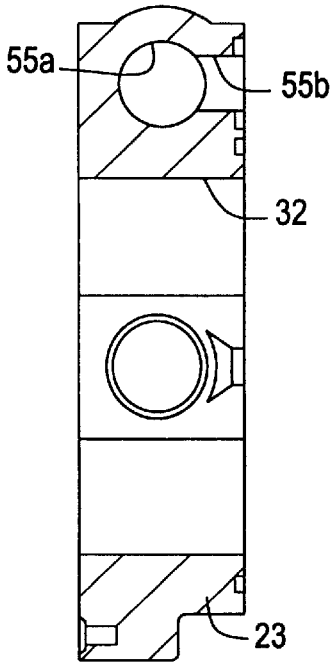
FIG. 6B is a cross sectional view taken along line VI—VI shown in FIG. 6A.
Figure 11:
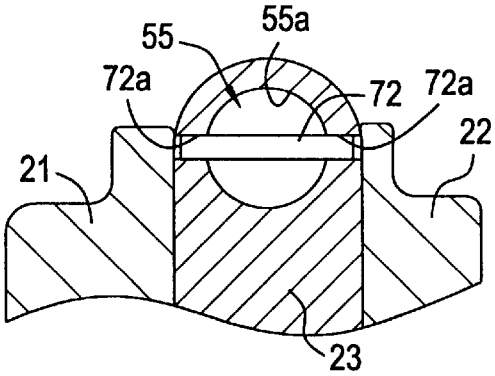
FIG. 11 is a cross sectional view taken along line XI—XI shown in FIGS. 5A to 5C.
Figure 7A:
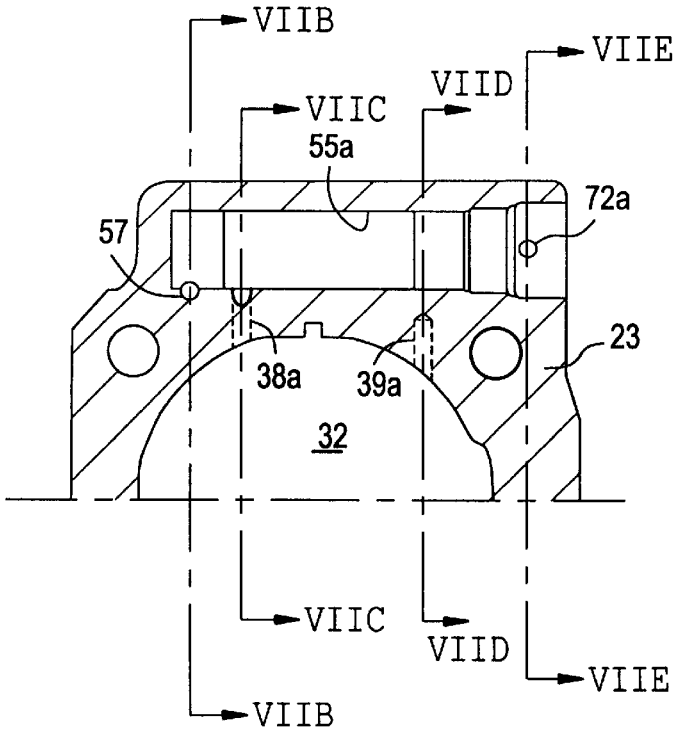
FIG. 7A is a cross sectional view showing an essential portion of the cam case of the variable displacement pump shown in FIG. 1 and FIGS. 7B to 7E are cross sectional views taken along lines B—B, C—C, D—D and E—E, respectively.
Figure 7B:
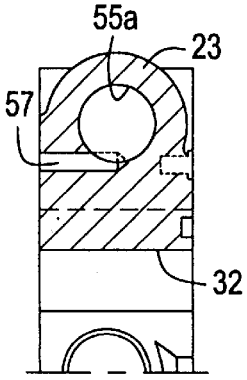
Figure 7C:
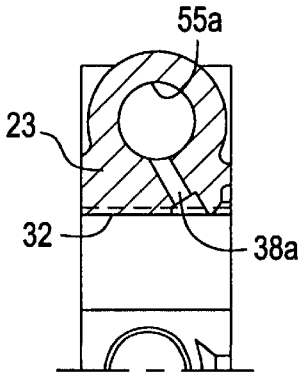
Figure 7D:
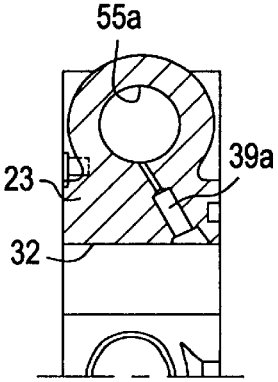
Figure 7E:
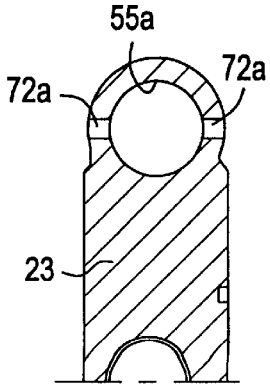

Since the above-mentioned structure is, as shown in FIG. 5C, arranged such that the high-pressure portion, such as the control valve 55, is disposed in the conventional front body 21, the high-pressure hydraulic passage for establishing the connection between the front body 21 and the discharge chamber 25 can be formed by combining the two passage holes 56*a* and 56*b* which penetrate the front body 21 through two different positions on the outer surface of the front body 21. Moreover, the structure for closing the opened ends with blind caps can be omitted. Therefore, the number of manufacturing processes can considerably be reduced and the blind caps and the like can be omitted. Thus, the cost can significantly be reduced. Since the above-mentioned structure is able to eliminate apprehension that oil leaks in the foregoing blind caps, reliability can be improved.

In the above-mentioned structure, the space for accommodating the conventional cam ring 34 and forming the first and second fluid pressure chambers 38 and 39 is created by the adapter ring inserted into the front body 21. Since the adapter ring is formed into a separate structure by the cam case 23 which serves as the intermediate body, the structure of the pump including the passages and grooves can be simplified. Thus, the passage holes and the like can easily be machined and the pump can easily be assembled.

In place of the conventional structure that the front body 21 and the rear body 22 are joined by a socket-and-spigot joint method, the rear body 22 can be formed to have a large thickness in the axial direction. Moreover, the suction port 50 can be provided for the rear side or the front side. The foregoing structure is able to improve the rigidity of the rear body 22. Since the front body 21 and the rear body 22 do not require close tolerance, the machining process can easily be performed.

Referring to FIGS. 2 and 3, reference numeral 35*a* represents a sealing member for defining the first and second fluid pressure chambers 38 and 39 formed in a pair disposed at symmetrical positions with respect to the swingable pin 35. Passage holes 38*a* and 39*a* for introducing fluid pressure across the metering orifice 60*a* from the control valve 55 are formed on the two sides of the sealing member 35*a* (see FIGS. 3, 6A–6B and 7A–7E). Moreover, a passage hole 55*b* (see FIGS. 1, 6A–6B and 8A–8C) is formed from the control valve 55 to suction-side passages 51 and 51*a*.

Since the other structures of the vane-type variable displacement pump 20 are known, the other structures are omitted from description.

In this embodiment, the spool valve is employed as the control valve 55 for controlling the fluid pressure for swinging the cam ring 34. The valve hole 55*a* for placing the spool-type control valve 55 is, as shown in FIGS. 1 and 3, formed in a direction perpendicular to the axial direction of the rotational shaft 40 such that an end of the valve hole 55*a* is outwards opened in a portion of the cam case 23. Then, the valve elements for constituting the control valve 55 are introduced into the valve hole 55*a* . Separation of a plug 71 which is a plug element is prevented as shown in FIGS. 3, 7A, 7E and 11 such that a through hole 72*a* is formed adjacent to an opened end of the valve hole 55*a* in a direction perpendicular (in the axial direction of the rotational shaft 40) to the valve hole 55*a*, the through hole 72*a* penetrating the cam case 23. Moreover, a pin, for example, a spring pin 72 is inserted into the through hole 72*a*. The two ends of the pin 72 are received by the end surfaces of the front body 21 and the rear body 22 which are joined to the two ends of the cam case 23 and which close the opened ends of the through hole 72*a*. Thus, separation is prevented.

The conventional structure is arranged such that the opened ends of the valve hole 55*a* of the spool-type control valve 55 are secured by mounting a stopper plug after the valve elements have been mounted. On the other hand, this embodiment has the structure that the simple spring pin 72 is employed to secure the opened end. Two ends of the spring pin 72 can be secured and stopped. Therefore, the thread cutting process required for the portion which receives the control valve 55 can be omitted. Moreover, the size can be reduced.

Moreover, generation of foreign matter, such as dust and iron powder, because of the conventional method of screwing the plug can be prevented. Since the spring pin 72 is employed, undesirably play of the valve element can easily be prevented.

Figure 8C:
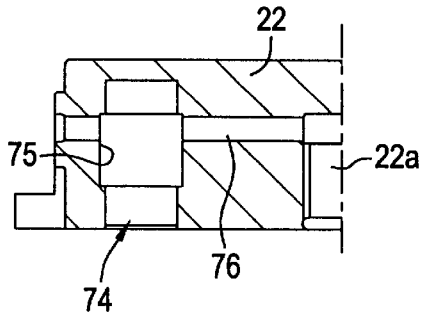
FIG. 8C is a cross sectional view taken along line VIIIc—VIIIc shown in FIG. 8A and showing an essential portion.
Figure 8A:
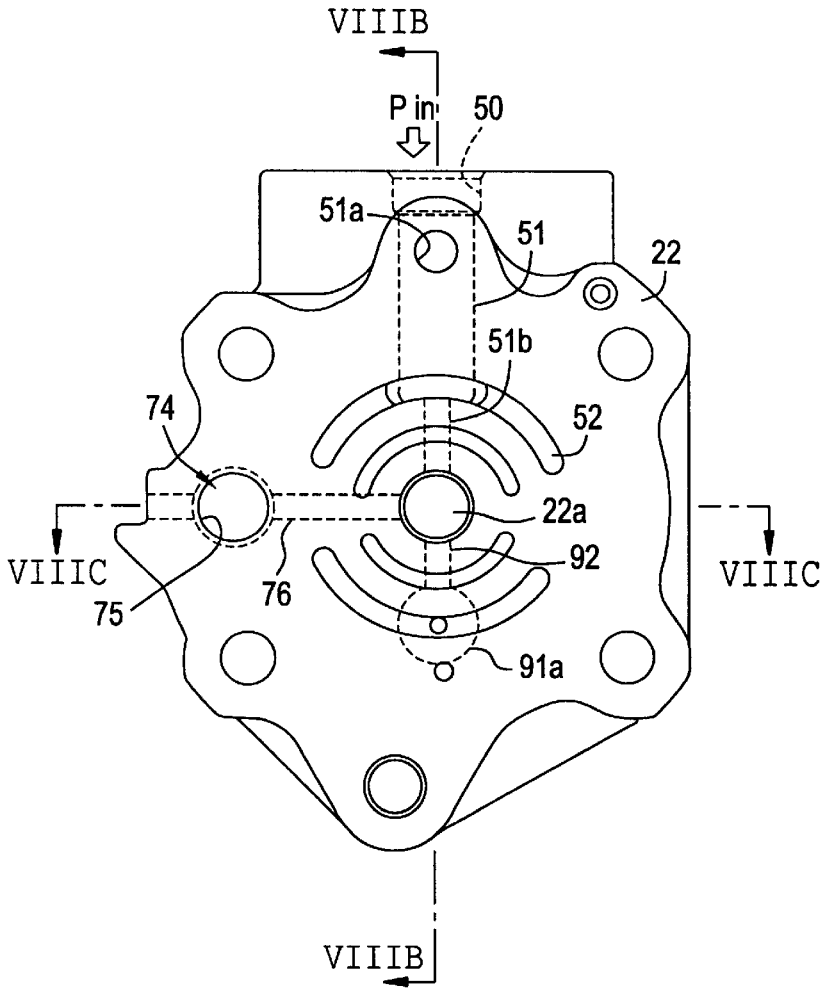
FIG. 8A is a side view showing a rear body of the variable displacement pump shown in FIG. 1 when viewed from the surface for joining the cam case.
Figure 8B:
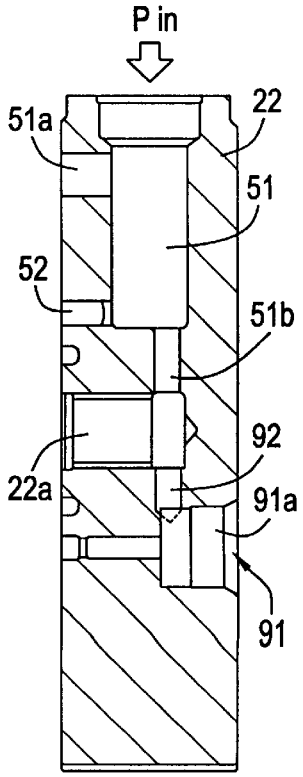
FIG. 8B is a cross sectional view taken along line VIIIb—VIIIb shown in FIG. 8A
Figure 9:
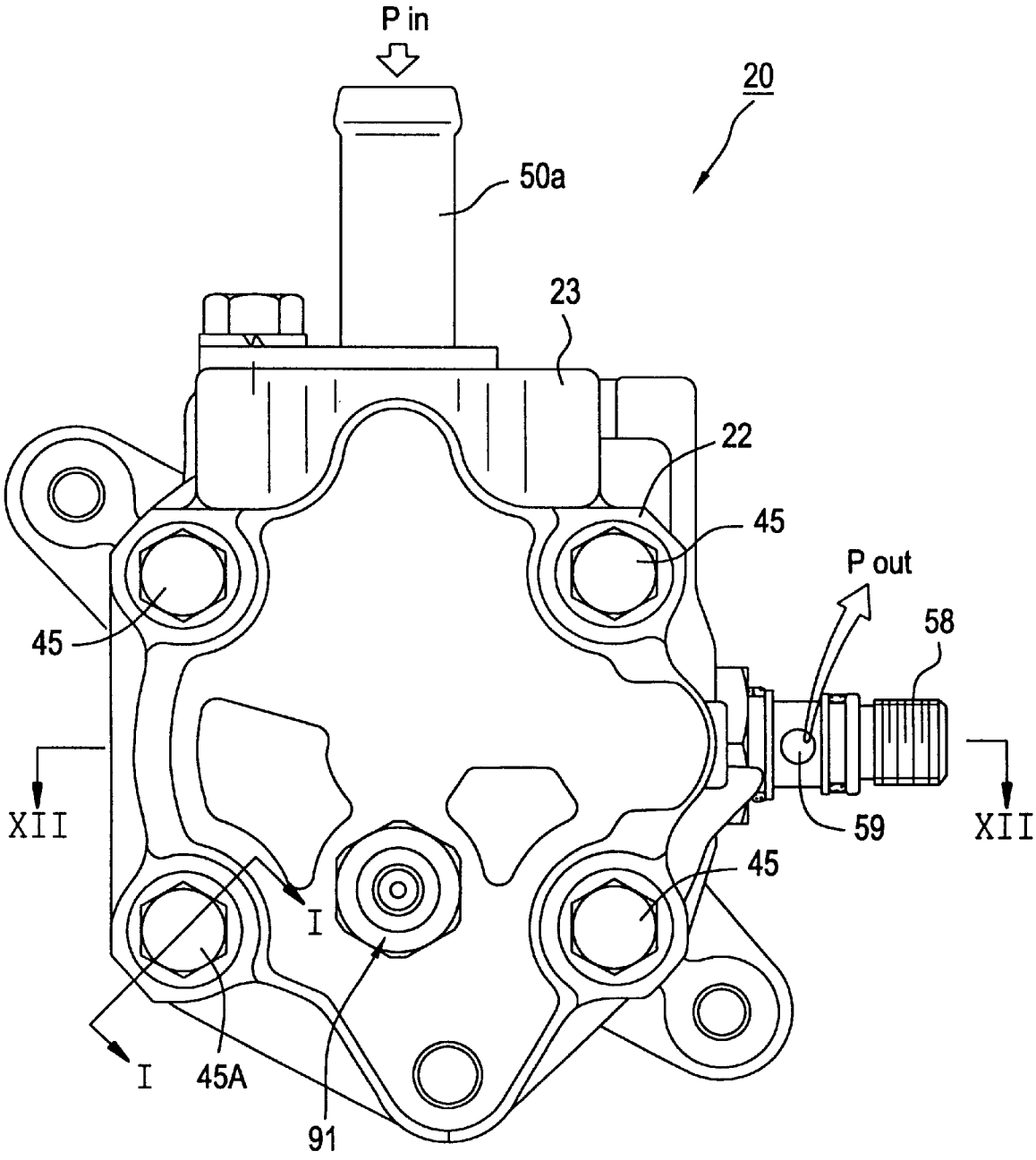
FIG. 9 is a side view showing the rear body portion of the variable displacement pump shown in FIG. 1.

In this embodiment, a relief valve 74 for relieving hydraulic oil to the suction side of the pump 20 when the fluid pressure in the discharge portion of the pump 20 is made to be not lower than a predetermined level is provided for the rear body 22 at a position between the discharge portion and the suction portion of the pump 20, as shown in FIGS. 8A, 8C and FIG. 12. That is, a valve hole 75 for receiving the relief valve 74 is formed by a blind cap having an end which is opened in the joining surface with the cam case 23 in the rear body 22. Valve elements 74*a* placed in the valve hole 75 are secured at the joining surface (or a portion of the front body 21) with the cam case 23.

A passage 76 which is connected a suction-side passage 51 in the suction side of the pump 20 through the passage hole 51*b* and the shaft hole 22*a* is connected to a portion of a valve hole 75 for the relief valve 74 in the form of a blind cap formed in the rear body 22. Reference numeral 76*a* represents a blind cap for closing an opened end formed by machining the passage 76 from the outside of the rear body 22.

A pressure detection switch 91 for detecting a state in which the fluid pressure in the discharge portion of the pump 20 has been made to be not lower than a predetermined level is disposed in a portion of the rear body 22. A passage 92 for establishing the connection between the low pressure portion of a switch hole 91*a* for receiving the pressure detection switch 91 is formed when the passage hole 51*b* is formed in the rear body 22 by machining such that the passage 92 is formed to penetrate the shaft hole 22*a*. Thus, the machining process can easily be performed and the cost can be reduced (see FIGS. 1 and 8A–8C).

The conventional structure has an arrangement that the stopper plug which is inserted into the opened end of the valve hole 75 of the relief valve 74 is a screw inserted into the opening formed in the outer surface of the rear body 22. In this embodiment, the plug is the straight plug (74*a* ) having the "O" ring. Moreover, the plug 74*a* can simply be borne by the cam case 23 or the front body 21. Therefore, the overall structure of the valve 74 can be simplified. Moreover, generation of foreign matter, such as dust and iron powder experienced with the conventional stopper plug can be prevented. In addition, the movement of the plug in the axial direction can be stopped at a required position.

Since the relief valve 74 and the passages 76 and 92 for connecting the low-pressure portion of the pressure detection switch 91 to the suction-side portion of the pump 20 are provided for the rear body 22 by a simple machining process, the number of machining processes and the cost can be reduced. Although the specific structure of the pressure detection switch 91 is omitted, any one of arbitrary pressure detection switch structures, for example, disclosed in Japanese Utility-Model Publication No. 2540145 may be employed.

The first and second fluid pressure chambers 38 and 39 for swinging the cam ring 34 by dint of the fluid pressure which is introduced in accordance with the flow rate discharged from the pump chamber 36 are formed on the two sides of the position between the swingable pin 35 and an opposite position (the sealing member 35*a* ) in the cam case 23. In this embodiment, the coil spring 37 serving as an urging means for urging the cam ring 34 in a direction in which the capacity in the pump chamber 36 is maximized is disposed in a hole 94 formed from the outer surface of the pump body (the cam case 23), the cam ring 34 being provided for the fluid-pressure chamber 39 of the two fluid-pressure chambers. Moreover, the discharge-side connector 58 for forming the discharge port (the discharge port 59) for the pressurized oil in the discharge portion of the pump is provided for the hole 94.

The above-mentioned structure enables the portion for receiving the coil spring 37 for urging the cam ring 34 and the discharge-side connector 58 to be used commonly. Therefore, the number of machining processes and the cost can be reduced. Moreover, the overall size of the pump can be reduced. Moreover, the cost can be reduced because the number of elements can be decreased.

Figure 4A:
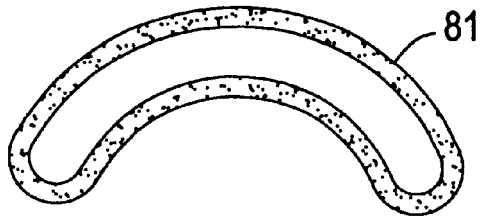
FIG. 4 is a side view taken along line IV—IV shown in FIG. 1 and showing a front body portion of the variable displacement pump.
Figure 4:
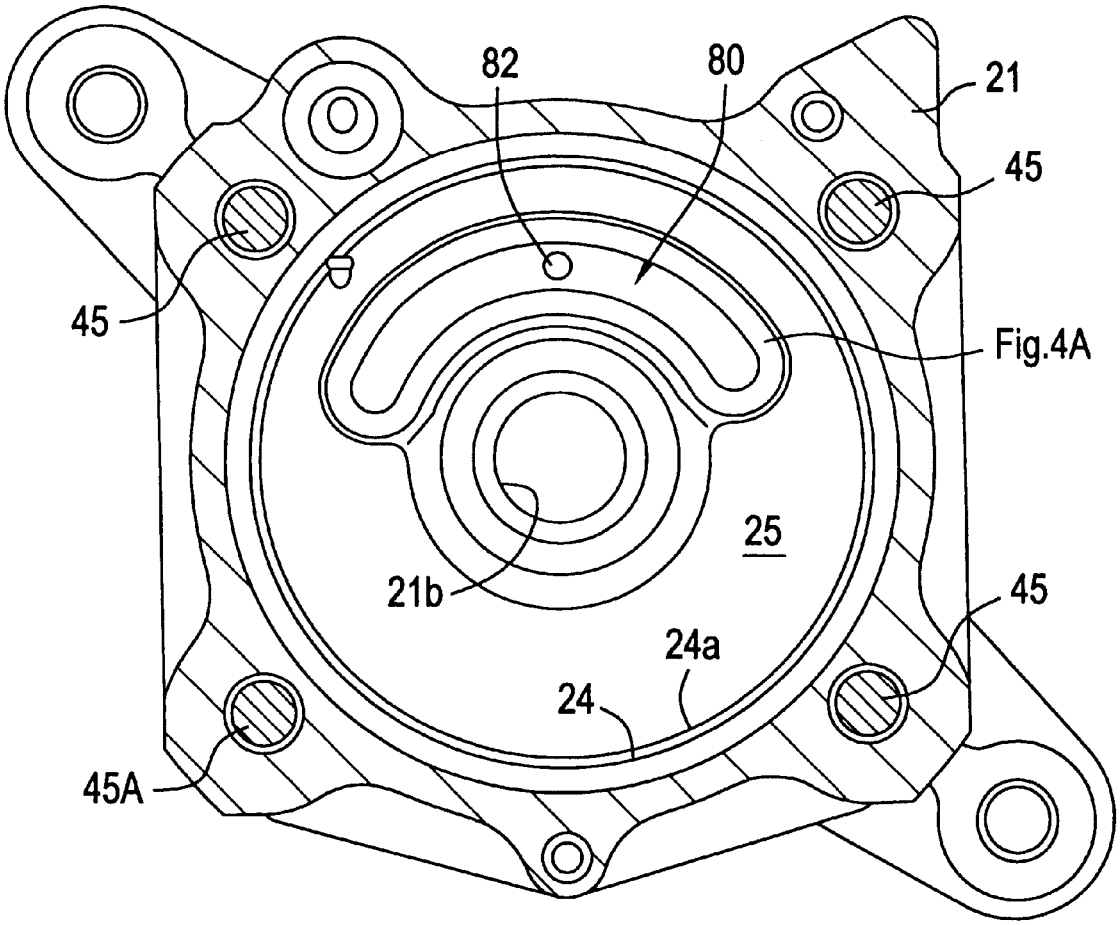

In this embodiment, the pressure plate 31 is disposed in the inside portion of the front body 21 to be in contact with the cam case 23, the pressure plate 31 being arranged to form the discharge chamber 25 for introducing pressurized oil in the discharge portion to the backside. A low-pressure chamber 80 for introducing low pressure hydraulic oil is formed into a recess, the low-pressure chamber 80 being formed between the backside of the pressure plate and the front body 21 at a position opposite to the suction-side region 36A of the pump chamber 36, as shown in FIGS. 1 and 4.

Reference numeral 81 represents an "O" ring in the form of an arc shape for sealing the low-pressure chamber 80 from the portion adjacent to the discharge chamber 25.

The above structure can keep a balance of hydraulic pressure on the two sides of the pressure plate 31 which is in contact with the pump chamber 36 formed by the rotor 33 and the cam ring 34. Thus, deformation of the pressure plate 31 can be prevented.

When the ratio of the area of the recess portion which is formed into the low-pressure chamber 80 for low-pressure hydraulic pressure is determined properly, the pressure plate 31 can adequately be deformed. By using a state of the deformation, the degree of contact with the cam ring 34 which forms the pump chamber can be adjusted. Thus, internal leakage occurring when the pressure is high can be prevented.

Referring to FIGS. 1 and 4, reference numeral 82 represents a return passage for returning hydraulic oil leaked to the portion including the oil seal 43 to the suction portion of the pump 20.

Referring to FIGS. 1 and 10A–10C, reference numerals 83 and 83*a* represent recess grooves which connect the low-pressure chamber 80 with the suction portion of the pump 20 and which serve as a passage hole and an opening in the suction portion for maintaining the low pressure. Reference numeral 31B shown in the drawings represents a shaft hole of the pressure plate 31. Reference numeral 31*c* represents a groove portion connected through the hole portion 31*a* for introducing the pressure in the discharge portion of the pump 20 into the base portion of the vane 33*a*.

Figure 10B:
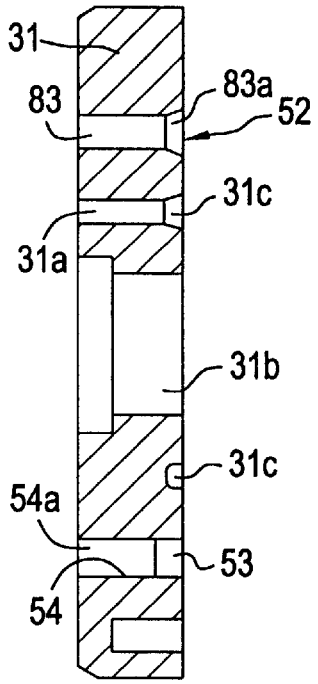
FIG. 10B is a side cross sectional view and FIG. 10C is a diagram showing a modification of the structure shown in FIG. 10B.
Figure 10A:
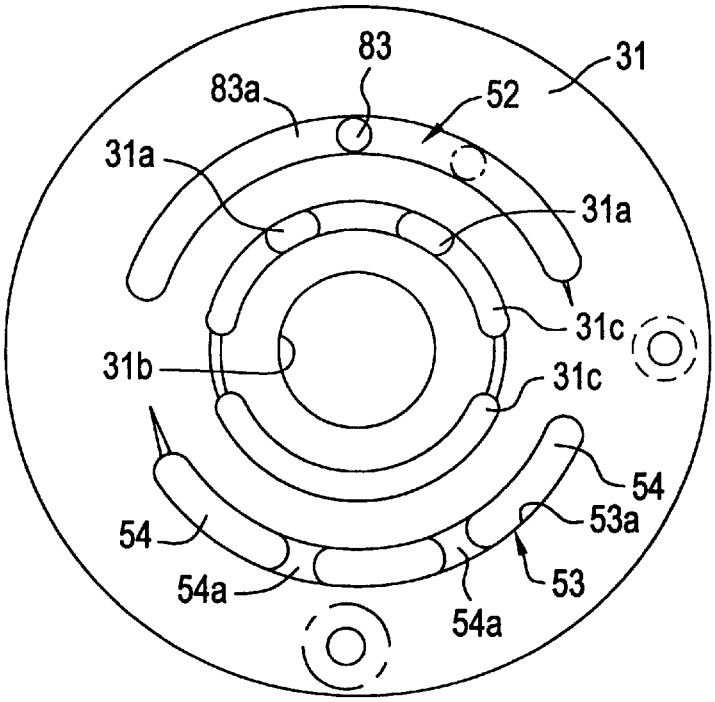
FIG. 10A is a side view showing a portion of a pressure plate adjacent to a pump chamber of the variable displacement pump shown in FIG. 1.

In this embodiment, the pressure plate 31 is arranged as shown in FIGS. 1, 10A and 10B such that a bridge portion 54*a* is provided for at least either (which is discharge-side passage 54 in this case) of the recess groove 83*a* or the discharge-side opening 53 provided for the pressure plate 31 to correspond to the suction-side region 36A and the discharge-side region 36B of the pump chamber 36.

The bridge portions 54*a* is formed in the recess groove 83*a* which is formed into the suction-side opening 52 and the recess groove 53*a* of the discharge-side opening 53, the bridge portions 54*a* being disposed apart from the end surface adjacent to the pump chamber 36.

As shown in FIGS. 10A and 10B, the recess groove 53*a* forming the discharge-side opening 53 has the circular through passage hole (the portion given reference numeral 54). The present invention is not limited to this. A structure shown in FIG. 10C may be employed.

Figure 10C:
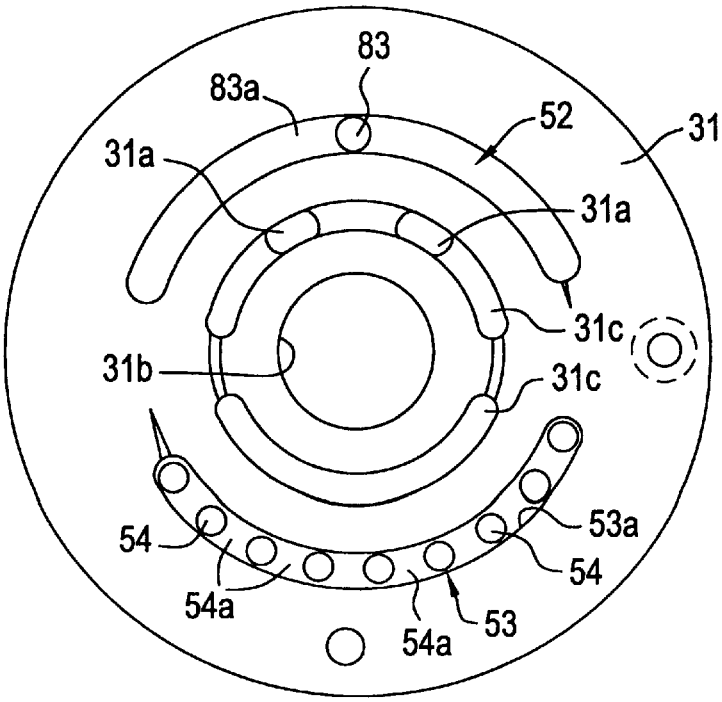

That is, FIG. 10C shows each portion between circular holes 54 which is formed into the bridge portion 54*a* by forming the discharge-side opening (or the suction-side opening 52) of the pump 20 with a plurality of the circular holes 54.

Deterioration in the rigidity of the pressure plate 31 occurring because of the existence of the suction-side opening 52 and the discharge-side opening 53 can be prevented by the bridge portions 54*a*, the suction-side opening 52 and the discharge side opening 53 having substantially circular-arc shapes provided for the pressure plate 31 to correspond to the suction-side region 36A and the discharge-side region 36B of the pump chamber 36. Thus, required rigidity can be maintained.

The numbers and positions of the bridge portions 54*a* may arbitrarily be determined in consideration of the required rigidity for the pressure plate 31. The suction-side opening 52 and the discharge-side opening 53 having the bridge portions 54*a* can be formed to have arbitrary shapes by molds (or casting molds) When the bridge portions 54*a* are formed by combining the circular holes 54, simple molded holes (cast holed) obtainable when the pressure plate 31 is manufactured may be employed. Thus, the cost can be reduced.

The present invention is not limited to the above-mentioned embodiment. The shapes and structures may be modified and changed and a variety of modifications may be employed.

Figure 13:
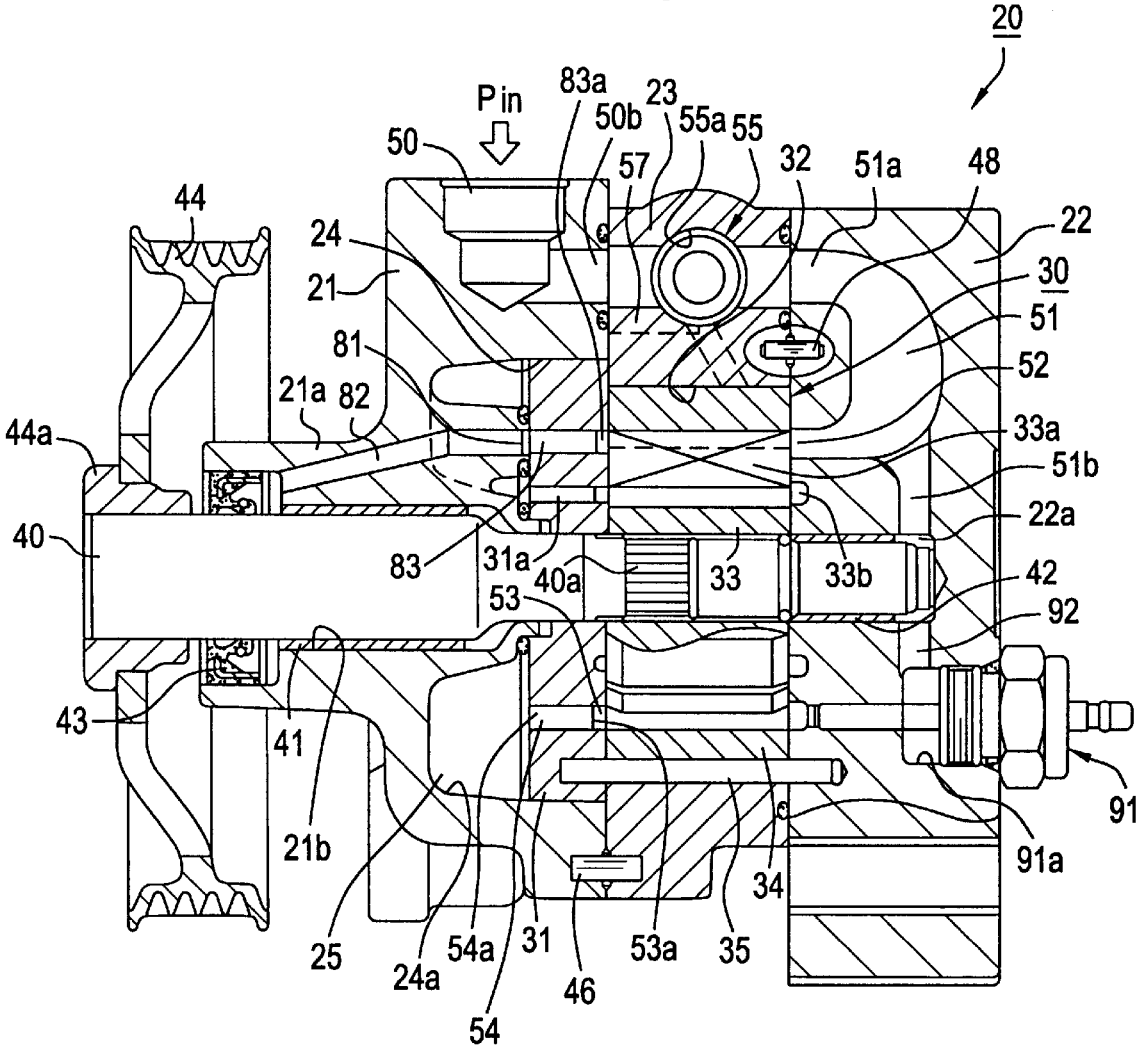
FIG. 13 is a side cross sectional view showing a modification of the variable displacement pump according to the present invention.

Although the above-mentioned embodiment has the structure that the suction port 50 of the pump 20 is provided for the rear body 22, the present invention is not limited to this. The suction port 50 may be provided for the front body 21 so as to be connected to the suction-side passage 51 provided for the rear body 22 through the low pressure portion of the valve hole 55*a* constituting the control valve 55 provided for the cam case 23, as shown in FIG. 13. Reference numeral 50*b* represents a passage hole for connecting the suction port 50 of the front body 21 to the portion including the cam case 23.

In the structure shown in FIG. 13, the passage 76 for establishing the connection between a portion of the valve hole 75 for the relief valve 74 in the form of a blind hole formed in the rear body 22 to the suction portion of the pump 20 is formed by a core cast hole when the rear body 22 is manufactured by casting. As a result, the processes for forming the passage holes of the rear body 22 can be minimized and an advantage can be obtained when the machining operation is performed, as shown in FIGS. 13, 14A to 14C. Moreover, an advantage can be obtained as compared with the structure shown in FIG. 12 that the blind cap 76*a* can be omitted. As can be understood from a comparison between FIGS. 12 and 14A–14C, the structures of the passages can freely be designed.

Also the passage 92 for connecting, to the suction portion of the pump 20, the low pressure portion of the switch hole 91*a* for receiving the pressure detection switch 91 disposed in a portion of the rear body 22 and arranged to detect a state in which the fluid pressure in the discharge side of the pump 20 has been made to a level not lower than a predetermined level may be formed by using a core in a molding process for casting the rear body 22. In this case, the machining operation can easily be performed and the cost can be reduced.

As described above, the passages 76 and 92 for connecting the low pressure portions of the relief valve 74 and the pressure detection switch 91 to the suction portion of the pump 20 are simultaneously molded by using cores when the rear body 22 is manufactured by casting. Therefore, the number of machining processes and the cost can be reduced.

Figure 15:
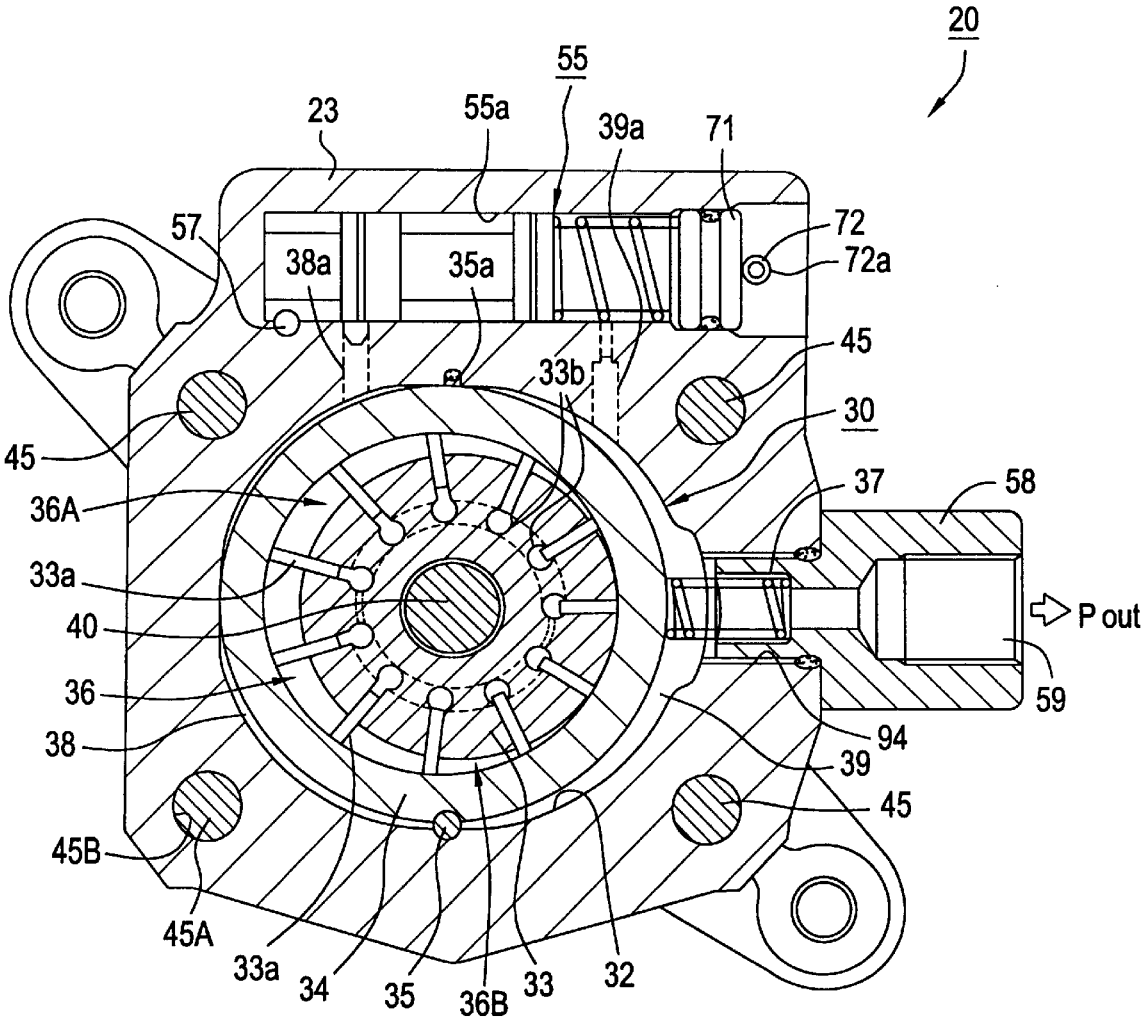
FIG. 15 is a side cross sectional view showing another embodiment of the variable displacement pump according to the present invention.

In the foregoing embodiment, the discharge-side connector 58 having the discharge-side port 59 and disposed in the discharge portion of the pump 20 has the structure that the discharge-side port 59 is opened in the direction perpendicular to the axial direction of the discharge-side connector 58, as shown in FIG. 3. The present invention is not limited to this. A simple structure may be employed in which the discharge-side port 59 is opened in the axial direction of the discharge-side connector 58, as shown in FIG. 15. The vane-type variable displacement pump 20 having the above-mentioned structure is not limited to the above-mentioned embodiment. The pump 20 may be applied to any one of various apparatuses and units as well as the power steering unit according to the embodiment.

As described above, the variable displacement pump according to the present invention has the structure that the swingable pin for swingably supporting the cam ring in the cam case is employed as one of the locating means when the front body, the rear body and the intermediate body disposed between the front body and the rear body are assembled. Therefore, the common part is employed as the locating element. Thus, the number of elements of the pump can be decreased. Moreover, the cam case and the two bodies can reliably be located in the directions of the planes and the circumferential directions.

According to the present invention, the other locating means is the reamer bolt which is the means for joining the two bodies and the cam case to one another. Therefore, any eccentric load acting on the two bodies and the cam case can reliably be borne by the reamer bolt. Thus, the reliability can be maintained when the pump is assembled and during the operation of the pump.

Since the present invention incorporates the locating pin which also serves as the swingable pin, the two bodies and the cam case can easily be located and assembled without use of the costly reamer bolt. When the hole into which the locating pin is inserted is the hole which is formed when the two bodies and the cam case are precisely cast, the machining process can easily be performed. Since the joining bolt can freely be clamped in the foregoing case, the assembling process can easily be performed.

The conventional structure has the arrangement that the spaces for accommodating the cam ring and forming the first and second fluid pressure chambers are formed by the adapter ring inserted into the internal space of the front body. The present invention has the structure that the adapter ring is formed by the cam case which is the intermediate body. Therefore, the structure of the pump can be simplified and the machining and assembling processes can easily be performed.

Since the present invention enables the blind caps and so forth to be omitted, the cost can significantly be reduced. Moreover, the apprehension that oil is leaked in the blind cap portion can be eliminated. Thus, the reliability can be improved.

Since the thickness of the rear body can be enlarged according to the present invention, the suction port of the pump may be formed in either of the rear portion or the front portion. Since the foregoing structure is able to improve the rigidity of the rear body, the front and rear bodies do not need precise accuracy in terms of dimensions. Therefore, the machining process can easily be performed.

Since the present invention enables the opened end of the valve hole for the spool-type control valve to be secured by a simple pin, such as a spring pin, the thread cutting work required for the portion for receiving the control valve can be omitted. Moreover, the size can be reduced. Therefore, the thickness and weight of the cam case can be reduced.

Moreover, generation of dust and iron powder during the process for screwing the plug as experienced with the conventional structure can be prevented. If the spring pin is employed as the securing pin, play of the elements of the valve can easily be prevented.

What is claimed is:

1. A variable displacement pump comprising:

a cam ring for forming a pump chamber from a rotor in a state where said rotor having a vane is moved to an eccentric position;

a cam case mounted on a portion around said cam ring to swingably support said cam ring such that a swingable pin axially disposed in a portion of an outer periphery of said cam ring in a circumferential direction of said cam ring serves as a fulcrum so that the capacity of said pump chamber is changed, said cam case urging said cam ring in a direction in which the capacity of said pump chamber is maximized;

front and rear bodies axially disposed on the two sides of said cam case to form a pump body;

a rotational shaft pivotally supported by said two bodies so as to rotate said rotor; and locating means for locating said two bodies and said cam case during an assembling process;

wherein said swingable pin serves as one of said locating means.

2. A variable displacement pump according to claim 1, further comprising:

joining means for integrally connecting said cam case and said two bodies to each other in a state in which said cam case is held between said two bodies;

wherein at least one of said joining means is a reamer bolt which is screwed into a reamer hole, and said reamer bolt, together with said swingable pin, serves as said locating means for locating said two bodies and said cam case.

3. A variable displacement pump according to claim 1, wherein a locating pin is provided to, together with said swingable pin, serve as said locating means for locating said two bodies and said cam case.

4. A variable displacement pump according to claim 3, wherein said locating pins are disposed between said front body and said cam case and between said cam case and said rear body.

5. A variable displacement pump comprising:

a cam ring for forming a pump chamber from a rotor in a state in which said rotor having a vane is moved to an eccentric position;

a cam case mounted on a portion around said cam ring to swingably support said cam ring such that a swingable pin axially disposed in a portion of an outer periphery of said cam ring in a circumferential direction of said cam ring serves as a fulcrum so that the capacity of said pump chamber is changed, said cam case urging said cam ring in a direction in which the capacity of said pump chamber is maximized;

front and rear bodies axially disposed on the two sides of said cam case which serves as an intermediate body so that said front and rear bodies form a pump body;

rotational shaft pivotally supported by said two bodies so as to rotate said rotor;

a high-pressure chamber which is formed in said front body and into which pressure discharged from said pump chamber is introduced; and a high-pressure portion formed in said cam case;

wherein a hydraulic passage for the high-pressure portion is constituted by a diagonal hole formed from said high-pressure chamber in said front body to be opened in an end surface which is a surface for joining said cam case and a hole for establishing the connection between said end surface of said cam case and said high-pressure portion.

6. A variable displacement pump according to claim 5, wherein a control valve for swinging said cam ring is provided for said cam case; and wherein a hydraulic passage for the high-pressure portion is constituted by a diagonal hole formed from said high-pressure chamber in said front body to be opened in an end surface which is a surface for joining said cam case and a hole for establishing the connection between said end surface of said cam case and said control valve.

7. A variable displacement pump comprising:

a cam ring for forming a pump chamber from a rotor in a state in which said rotor having a vane is moved to an eccentric position;

a cam case mounted on a portion around said cam ring to swingably support said cam ring such that a swingable pin axially disposed in a portion of an outer periphery of said cam ring in a circumferential direction of said cam ring serves as a fulcrum so that the capacity of said pump chamber is changed, said cam case urging said cam ring in a direction in which the capacity of said pump chamber is maximized;

front and rear bodies axially disposed on the two sides of said cam case which serves as an intermediate body so that said front and rear bodies form a pump body;

a rotational shaft pivotally supported by said two bodies so as to rotate said rotor; and a spool-type control valve for swinging said cam ring;

wherein a valve hole for forming said spool-type control valve provided for said cam case such that an end of said valve hole is opened in said cam case; and wherein a hole is formed adjacent to an opened end of said valve hole in a direction perpendicular to said valve hole such that said hole penetrates said cam case, and a pin is inserted into said hole.

* * * * *